US012302939B2

(12) United States Patent
Zawadzki et al.

(10) Patent No.: US 12,302,939 B2
(45) Date of Patent: May 20, 2025

(54) ALTERNATIVE METHODS FOR WHITENING TOBACCO

(71) Applicant: NICOVENTURES TRADING LIMITED, London (GB)

(72) Inventors: Michael Andrew Zawadzki, Clemmons, NC (US); David Neil McClanahan, Winston-Salem, NC (US)

(73) Assignee: NICOVENTURES TRADING LIMITED, London (GB)

( * ) Notice: Subject to any disclaimer, the term of this patent is extended or adjusted under 35 U.S.C. 154(b) by 0 days.

(21) Appl. No.: 18/375,095

(22) Filed: Sep. 29, 2023

(65) Prior Publication Data

US 2024/0023593 A1 Jan. 25, 2024

Related U.S. Application Data

(62) Division of application No. 17/017,451, filed on Sep. 10, 2020, now Pat. No. 11,805,804.

(60) Provisional application No. 62/898,890, filed on Sep. 11, 2019.

(51) Int. Cl.

| | |
|---|---|
| ***A24B 15/24*** | (2006.01) |
| ***A24B 13/00*** | (2006.01) |
| ***A24B 15/28*** | (2006.01) |
| ***A24B 15/32*** | (2006.01) |

(52) U.S. Cl.

CPC ..... *A24B 15/24* (2013.01); *A24B 13/00* (2013.01); *A24B 15/287* (2013.01); *A24B 15/32* (2013.01)

(58) Field of Classification Search

None

See application file for complete search history.

(56) References Cited

U.S. PATENT DOCUMENTS

| | | | |
|---|---|---|---|
| 787,611 | A | 4/1905 | Daniels, Jr. |
| 1,086,306 | A | 2/1914 | Oelenheinz |
| 1,437,095 | A | 11/1922 | Delling |
| 1,757,477 | A | 5/1930 | Rosenhoch |
| 1,847,162 | A | 3/1932 | Andrews |

(Continued)

FOREIGN PATENT DOCUMENTS

| | | |
|---|---|---|
| BR | PI1106360 | 11/2013 |
| CA | 2183825 | 2/1997 |

(Continued)

OTHER PUBLICATIONS

Barros, et al., "*Effect of Last Stage Bleaching With Peracetic Acid on Brightness Development and Properties of Eucalyptus Pulp*;" BioResources, vol. 5, No. 2 (2010), pp. 881-898.

(Continued)

*Primary Examiner* — Dennis R Cordray

(74) *Attorney, Agent, or Firm* — Womble Bond Dickinson (US) LLP; Mark R. DeLuca

(57) ABSTRACT

The present disclosure provides a method of preparing whitened tobacco composition including chemically pulping a tobacco material to form a tobacco pulp, extracting the tobacco pulp with an extraction solution, treating the tobacco pulp with a solution comprising an oxidizing agent for a time and at a temperature sufficient to lighten the color of the tobacco pulp to give a whitened tobacco pulp, and drying the whitened tobacco pulp to provide the whitened tobacco composition. Alternative bleaching processes and treatment methods effective for preparing whitened tobacco compositions are also provided herein.

11 Claims, 4 Drawing Sheets

(56) References Cited

U.S. PATENT DOCUMENTS

| | | | |
|---|---|---|---|
| 2,122,421 | A | 7/1938 | Hawkinson |
| 2,131,160 | A | 9/1938 | Avedikian |
| 2,148,147 | A | 2/1939 | Baier |
| 2,170,107 | A | 8/1939 | Baier |
| 2,274,649 | A | 3/1942 | Baier |
| 2,770,239 | A | 11/1956 | Prats et al. |
| 3,020,179 | A | 2/1962 | Hess |
| 3,361,139 | A | 1/1968 | Inoue |
| 3,612,065 | A | 10/1971 | Rosen |
| 3,851,653 | A | 12/1974 | Rosen |
| 3,889,689 | A | 6/1975 | Rosen |
| 3,943,940 | A | 3/1976 | Minami |
| 3,943,945 | A | 3/1976 | Rosen |
| 4,143,666 | A | 3/1979 | Rainer et al. |
| 4,144,895 | A | 3/1979 | Fiore |
| 4,150,677 | A | 4/1979 | Osborne, Jr. et al. |
| 4,194,514 | A | 3/1980 | Campbell |
| 4,267,847 | A | 5/1981 | Reid |
| 4,289,147 | A | 9/1981 | Wildman et al. |
| 4,343,317 | A | 8/1982 | Bokelman |
| 4,351,346 | A | 9/1982 | Brummer et al. |
| 4,355,648 | A | 10/1982 | Bokelman et al. |
| 4,359,059 | A | 11/1982 | Brummer et al. |
| 4,362,170 | A | 12/1982 | Keritsis et al. |
| 4,366,823 | A | 1/1983 | Rainer et al. |
| 4,366,824 | A | 1/1983 | Rainer et al. |
| 4,388,933 | A | 6/1983 | Rainer et al. |
| 4,506,682 | A | 3/1985 | Muller |
| 4,589,428 | A | 5/1986 | Keritsis |
| 4,605,016 | A | 8/1986 | Soga et al. |
| 4,641,667 | A | 2/1987 | Schmekel et al. |
| 4,716,911 | A | 1/1988 | Poulose et al. |
| 4,727,888 | A | 3/1988 | Luke |
| 4,727,889 | A | 3/1988 | Niven, Jr. et al. |
| 4,882,128 | A | 11/1989 | Hukvari et al. |
| 4,887,618 | A | 12/1989 | Bernasek et al. |
| 4,941,484 | A | 7/1990 | Clapp et al. |
| 4,967,771 | A | 11/1990 | Fagg et al. |
| 4,986,286 | A | 1/1991 | Roberts et al. |
| 5,005,593 | A | 4/1991 | Fagg |
| 5,018,540 | A | 5/1991 | Grubbs et al. |
| 5,060,669 | A | 10/1991 | White et al. |
| 5,065,775 | A | 11/1991 | Fagg |
| 5,074,319 | A | 12/1991 | White et al. |
| 5,099,862 | A | 3/1992 | White et al. |
| 5,121,757 | A | 6/1992 | White et al. |
| 5,131,414 | A | 7/1992 | Fagg et al. |
| 5,131,415 | A | 7/1992 | Munoz et al. |
| 5,148,819 | A | 9/1992 | Fagg |
| 5,197,494 | A | 3/1993 | Kramer |
| 5,230,354 | A | 7/1993 | Smith et al. |
| 5,234,008 | A | 8/1993 | Fagg |
| 5,243,999 | A | 9/1993 | Smith |
| 5,301,694 | A | 4/1994 | Raymond et al. |
| 5,318,050 | A | 6/1994 | Gonzalez-Parra et al. |
| 5,343,879 | A | 9/1994 | Teague |
| 5,360,022 | A | 11/1994 | Newton et al. |
| 5,435,325 | A | 7/1995 | Clapp et al. |
| 5,445,169 | A | 8/1995 | Brinkley et al. |
| 5,713,376 | A | 2/1998 | Berger |
| 5,810,020 | A | 9/1998 | Northway et al. |
| 6,058,940 | A | 5/2000 | Lane |
| 6,131,584 | A | 10/2000 | Lauterbach |
| 6,221,209 | B1 | 4/2001 | Desprez et al. |
| 6,298,859 | B1 | 10/2001 | Kierulff et al. |
| 6,679,270 | B2 | 1/2004 | Baskevitch et al. |
| 6,772,767 | B2 | 8/2004 | Mua et al. |
| 7,337,782 | B2 | 3/2008 | Thompson |
| 7,677,253 | B2 | 3/2010 | Yamada et al. |
| 7,861,728 | B2 | 1/2011 | Holton, Jr. et al. |
| 8,991,403 | B2 | 3/2015 | Chen et al. |
| 9,321,806 | B2 | 4/2016 | Lo et al. |
| 9,339,058 | B2 | 5/2016 | Byrd, Jr. et al. |
| 9,420,825 | B2 | 8/2016 | Beeson et al. |
| 9,950,858 | B2 | 4/2018 | Byrd, Jr. et al. |
| 2002/0134394 | A1 | 9/2002 | Baskevitch et al. |
| 2005/0034737 | A1 | 2/2005 | Kunz et al. |
| 2005/0241657 | A1 | 11/2005 | Mua et al. |
| 2006/0191548 | A1 | 8/2006 | Strickland et al. |
| 2007/0062549 | A1 | 3/2007 | Holton et al. |
| 2008/0178894 | A1 | 7/2008 | Zimmermann |
| 2009/0025738 | A1 | 1/2009 | Mua et al. |
| 2009/0126747 | A1 | 5/2009 | L'Heureux et al. |
| 2010/0126520 | A1 | 5/2010 | Clayton |
| 2010/0294292 | A1 | 11/2010 | Hodin et al. |
| 2010/0300463 | A1 | 12/2010 | Chen et al. |
| 2011/0048434 | A1 | 3/2011 | Chen et al. |
| 2011/0083683 | A1 | 4/2011 | Krauss |
| 2011/0247640 | A1 | 10/2011 | Beeson et al. |
| 2011/0315154 | A1 | 12/2011 | Mua et al. |
| 2012/0067361 | A1 | 3/2012 | Björkholm et al. |
| 2012/0152265 | A1 | 6/2012 | Dube et al. |
| 2012/0192880 | A1 | 8/2012 | Dube et al. |
| 2013/0206153 | A1 | 8/2013 | Beeson et al. |
| 2013/0276801 | A1 | 10/2013 | Byrd, Jr. et al. |
| 2014/0190497 | A1 | 7/2014 | Dube et al. |
| 2015/0305399 | A1 | 10/2015 | Kotrola et al. |
| 2016/0073686 | A1 | 3/2016 | Crooks |
| 2017/0020183 | A1 | 1/2017 | Björkholm |
| 2017/0112183 | A1 | 4/2017 | Björkholm |
| 2018/0266053 | A1 | 9/2018 | Sebastian et al. |
| 2020/0196658 | A1 | 6/2020 | McClanahan et al. |

FOREIGN PATENT DOCUMENTS

| | | |
|---|---|---|
| CN | 1477935 | 2/2004 |
| CN | 102943408 | 2/2013 |
| CN | 105725255 | 7/2016 |
| CN | 104532662 | 2/2017 |
| CN | 106942783 | 7/2017 |
| DE | 467964 | 11/1928 |
| DE | 635840 | 12/1936 |
| DE | 662320 | 7/1938 |
| DE | 671126 | 1/1939 |
| DE | 686442 | 1/1940 |
| DE | 3736335 | 5/1989 |
| DE | 29506564 | 6/1995 |
| EP | 3491940 | 6/2019 |
| FR | 379963 | 11/1907 |
| GB | 190312646 | 8/1903 |
| GB | 832991 | 4/1960 |
| GB | 884435 | 12/1961 |
| GB | 2 113 065 | 8/1983 |
| NL | 7810833 | 5/1980 |
| WO | WO 96/31255 | 10/1996 |
| WO | WO 97/19222 | 5/1997 |
| WO | WO 97/28305 | 8/1997 |
| WO | WO 2009/068279 | 6/2009 |
| WO | WO 2015/167430 | 11/2015 |
| WO | WO 2016/067226 | 5/2016 |
| WO | WO 2018/083114 | 5/2018 |

OTHER PUBLICATIONS

Borrega,et al., "Purification of Cellulosic Pulp by Hot Water Extraction;" Cellulose 20.6 (2013): 2803-2812.

Borrega, "*Hot Water Treatment of Hardwood Kraft Pulp Produces High-Purity Cellulose and Polymeric Xylan*;" Cellulose 24 (2017): 5133-5145.

Huang, C. et al., "Production of Dissolving Grade Pulp from Tobacco Stalk Through SO2-ethanol-water Fractionation, Alkaline Extraction, and Bleaching Processes," *BioResources*, 2019, vol. 14(3), pp. 5544-5558.

Li, Z. et al., "Hot Water Extraction of Hemicelluloses from Aspen Wood Chips of Different Sizes," *BioResources*, 2013, vol. 8(4), pp. 5690-5700.

Sun, X. et al., "Iso-concentration hydrogen peroxide bleaching of poplar chemi-thermomechanical pulp," *Journal of Bioresources and Bioproducts*, 2018, vol. 3(1), pp. 35-39.

Zhao, Q. et al., "Process Optimization of Tetra Acetyl Ethylene Diamine Activated Hydrogen Peroxide Bleaching of *Populus nigra* CTMP," *BioResources*, 2010, vol. 5(1), pp. 276-290.

(56) References Cited

OTHER PUBLICATIONS

Zhao, et al., "Single-Stage Pulping of Sugarcane Bagasse with Peracetic Acid," *Journal of Wood Chemistry and Technology*, 2011, vol. 31, No. 1, pp. 1-25.

ALTERNATIVE METHODS FOR WHITENING TOBACCO

CROSS-REFERENCE TO RELATED APPLICATIONS

The present application is a divisional of U.S. application Ser. No. 17/017,451, filed on Sep. 10, 2020, which claims priority to and the benefit of U.S. Provisional Application No. 62/898,890, filed on Sep. 11, 2019, the disclosures of which are incorporated herein by reference in their entirety.

FIELD OF THE INVENTION

The present invention relates to products made or derived from tobacco, or that otherwise incorporate tobacco, and are intended for human consumption.

BACKGROUND

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user.

Conventional formats for such smokeless tobacco products are include moist snuff, snus, and chewing tobacco, which are typically formed almost entirely of particulate, granular, or shredded tobacco, and which are either portioned by the user or presented to the user in individual portions, such as in single-use pouches or sachets. Other traditional forms of smokeless products include compressed or agglomerated forms, such as plugs, tablets, or pellets. Alternative product formats, such as tobacco-containing gums and mixtures of tobacco with other plant materials, are also known. See for example, the types of smokeless tobacco formulations, ingredients, and processing methodologies set forth in U.S. Pat. No. 1,376,586 to Schwartz; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0209586 to Neilsen et al.; 2009/0065013 to Essen et al.; and 2010/0282267 to Atchley, as well as WO2004/095959 to Arnarp et al., each of which is incorporated herein by reference.

Smokeless tobacco product configurations that combine tobacco material with various binders and fillers have been proposed more recently, with example product formats including lozenges, pastilles, gels, extruded forms, and the like. See, for example, the types of products described in US Patent App. Pub. Nos. 2008/0196730 to Engstrom et al.; 2008/0305216 to Crawford et al.; 2009/0293889 to Kumar et al.; 2010/0291245 to Gao et al; 2011/0139164 to Mua et al.; 2012/0037175 to Cantrell et al.; 2012/0055494 to Hunt et al.; 2012/0138073 to Cantrell et al.; 2012/0138074 to Cantrell et al.; 2013/0074855 to Holton, Jr.; 2013/0074856 to Holton, Jr.; 2013/0152953 to Mua et al.; 2013/0274296 to Jackson et al.; 2015/0068545 to Moldoveanu et al.; 2015/0101627 to Marshall et al.; and 2015/0230515 to Lampe et al., each of which is incorporated herein by reference. Additionally, all-white snus portions are growing in popularity, and offer a discrete and aesthetically pleasing alternative to traditional snus. Such modern "white" pouched products may include a bleached tobacco or may be tobacco-free.

Through the years, various treatment methods and additives have been proposed for altering the overall character or nature of tobacco materials utilized in tobacco compositions. For example, additives or treatment processes are sometimes utilized in order to alter the chemistry or sensory properties of the tobacco material, or in the case of smokable tobacco materials, to alter the chemistry or sensory properties of mainstream smoke generated by smoking articles including the tobacco material. In some cases, a heat treatment process can be used to impart a desired color or visual character to the tobacco material, desired sensory properties to the tobacco material, or a desired physical nature or texture to the tobacco material.

It would be desirable in the art to provide further methods for altering the character and nature of tobacco (and tobacco compositions and formulations) useful in smoking articles or smokeless tobacco products. In particular, an improved tobacco whitening process and whitened tobacco material is desirable.

BRIEF SUMMARY

The present disclosure provides methods for processing a tobacco material to modify the color of the tobacco material, specifically to provide a tobacco material that is lightened in color (i.e., "whitened"). The whitened tobacco material can be used in smokeless tobacco materials to give materials adapted for oral use with a whitened appearance.

A first aspect of the present disclosure provides a method of preparing a whitened tobacco material, the method comprising: treating a tobacco material with a caustic wash to form a tobacco pulp; extracting the tobacco pulp with an extraction solution to provide an extracted tobacco pulp and a tobacco extract; bleaching the extracted tobacco pulp with a bleaching solution comprising an oxidizing agent to provide a bleached tobacco pulp; and drying the bleached tobacco pulp to provide a whitened tobacco material. In some embodiments, the extraction solution may be an aqueous solution. In some embodiments, the extraction solution comprises a chelating agent. In some embodiments, the chelating agent comprises one or more of EDTA and DTPA. In some embodiments, the caustic wash comprises at least one strong base. In certain embodiments, the strong base is sodium hydroxide. In some embodiments, the oxidizing agent is hydrogen peroxide. In some embodiments, the disclosed method may further comprise one or more additional bleaching treatments following the bleaching of the extracted tobacco pulp and prior to the drying of the bleached tobacco pulp. In some embodiments, the one or more additional bleaching treatments may further comprise treating the bleached tobacco pulp with a strong base, an oxidizing agent, or a combination thereof for a time and at a temperature sufficient to lighten the color of the tobacco pulp to give a whitened tobacco pulp.

In some embodiments, the tobacco material may comprise lamina, roots, stalks, stems, or a combination thereof. In some embodiments, the disclosed method may further comprise milling the tobacco material such that the tobacco material is able to pass through a screen of 18 U.S. sieve size. In certain embodiments, the tobacco material can be milled to a size in the range of approximately 0.2 mm to about 2 mm. In some embodiments, the step of treating the tobacco material with a caustic wash is done at atmospheric pressure. In some embodiments, the bleached tobacco pulp may be dried to a moisture content of less than about 30 percent moisture on a wet basis. In some embodiments, the method may further comprise dewatering the tobacco material using at least one of a screw press and a basket centrifuge following treating the tobacco material, extracting the tobacco pulp, and/or bleaching to the extracted tobacco pulp.

In some embodiments, the bleaching solution may further comprise treatment with one or more stabilizers in addition to an oxidizing agent. In some embodiments, the stabilizers may be selected from the group consisting of magnesium sulfate, sodium silicate, and combinations thereof. In some embodiments, the method may further comprise neutralizing the bleached pulp material to a pH in the range of about 5 to about 11 prior to drying the bleached tobacco pulp. In various embodiments, the method may further comprise milling the whitened tobacco material following drying the bleached tobacco pulp to a size in the range of approximately 5 mm to about 0.1 mm. In some embodiments, the molar ratio of the extraction solution to the tobacco material in the treatment step (ii) is from about 4:1 to about 16:1. In some embodiments, the whitened tobacco material comprises at least about 90% by weight roots, stalks, or a combination thereof.

In some embodiments, the method may further comprise mixing the tobacco pulp with a wood pulp prior to bleaching the extracted tobacco pulp. In some embodiments, the method may further comprise incorporating the whitened tobacco material within a smokeless tobacco product. In some embodiments, the smokeless tobacco product further comprises one or more additional components selected from the group consisting of flavorants, fillers, binders, pH adjusters, buffering agents, colorants, disintegration aids, antioxidants, humectants, and preservatives.

A second aspect of the present disclosure provides a method of preparing a whitened tobacco material, the method comprising: treating a tobacco material with an extraction solution comprising an acid component to provide a tobacco pulp and a tobacco extract, wherein the tobacco material is treated for a time and at a temperature sufficient to lighten the color of the tobacco pulp to give a whitened tobacco pulp; and drying the whitened tobacco pulp to provide the whitened tobacco material. In some embodiments, the extraction solution is an aqueous solution. In some embodiments, the acid component may be peracetic acid. In some embodiments, the acid component may comprise a mineral acid and an oxidizer.

In some embodiments, the tobacco material is treated at a pressure greater than ambient pressure. In some embodiments, the tobacco material is treated at a pH of about 7 or less. In some embodiments, the tobacco material is treated at a temperature of at least about 200° C. In some embodiments, the whitened tobacco pulp is dried to a moisture content of less than about 30 percent moisture on a wet basis. In some embodiments, the method according to this embodiment may further comprise milling the whitened tobacco material following drying the whitened tobacco pulp to a size in the range of approximately 5 mm to about 0.1 mm. In some embodiments, the method may further comprise incorporating the whitened tobacco material within a smokeless tobacco product. In such embodiments, the smokeless tobacco product may further comprise one or more additional components selected from the group consisting of flavorants, fillers, binders, pH adjusters, buffering agents, colorants, disintegration aids, antioxidants, humectants, and preservatives.

A third aspect of the present disclosure provides for a method of preparing a whitened tobacco material, the method comprising: subjecting a tobacco material to hot water extraction for a time and at a temperature and a pressure sufficient to lighten the color of the tobacco material to give a whitened tobacco solids material and a tobacco extract; and drying the whitened tobacco solids material to provide the whitened tobacco material. In some embodiments, the hot water extraction further comprises a bleaching agent. In some embodiments, the hot water extraction comprises mixing the tobacco material with hot water or steam in a pressurized vessel. In some embodiments, the pressure within the pressurized vessel is in the range of about 30 bar to about 50 bar. In some embodiments, the temperature within the pressurized vessel is in the range of about 200° C. to about 240° C.

In various embodiments, the whitened tobacco solids material is dried to a moisture content of less than about 30 percent moisture on a wet basis. In some embodiments, the method may further comprise milling the whitened tobacco material following step (ii) to a size in the range of approximately 5 mm to about 0.1 mm. In some embodiments, the method may further comprise incorporating the whitened tobacco material within a smokeless tobacco product. In some embodiments, the smokeless tobacco product further comprises one or more additional components selected from the group consisting of flavorants, fillers, binders, pH adjusters, buffering agents, colorants, disintegration aids, antioxidants, humectants, and preservatives.

The invention includes, without limitation, the following embodiments.

Embodiment 1: A method of preparing a whitened tobacco material, the method comprising: (i) treating a tobacco material with a caustic wash to form a tobacco pulp; (ii) extracting the tobacco pulp with an extraction solution to provide an extracted tobacco pulp and a tobacco extract; (iii) bleaching the extracted tobacco pulp with a bleaching solution comprising an oxidizing agent to provide a bleached tobacco pulp; and (iv) drying the bleached tobacco pulp to provide a whitened tobacco material.

Embodiment 2: A method of any preceding embodiment, wherein the extraction solution is an aqueous solution.

Embodiment 3: A method of any preceding embodiment, wherein the extraction solution comprises a chelating agent.

Embodiment 4: A method of any preceding embodiment, wherein the extraction solution comprises a chelating agent, and wherein the chelating agent comprises one or more of EDTA and DTPA.

Embodiment 5: A method of any preceding embodiment, wherein the caustic wash comprises at least one strong base.

Embodiment 6: A method of any preceding embodiment, wherein the caustic wash comprises at least one strong base, and wherein the strong base is sodium hydroxide.

Embodiment 7: A method of any preceding embodiment, wherein the oxidizing agent is hydrogen peroxide.

Embodiment 8: A method of any preceding embodiment, further comprising one or more additional bleaching treatments following the bleaching of the extracted tobacco pulp and prior to the drying of the bleached tobacco pulp.

Embodiment 9: A method of any preceding embodiment, further comprising one or more additional bleaching treatments following the bleaching of the extracted tobacco pulp and prior to the drying of the bleached tobacco pulp, wherein the one or more additional bleaching treatments further comprise treating the tobacco pulp with a strong base, an oxidizing agent, or a combination thereof for a time and at a temperature sufficient to lighten the color of the tobacco pulp to give a whitened tobacco pulp.

Embodiment 10: A method of any preceding embodiment, wherein the tobacco material comprises lamina, roots, stalks, stems, or a combination thereof.

Embodiment 11: A method of any preceding embodiment, further comprising milling the tobacco material to a size in the range of approximately 0.2 mm to about 2 mm.

Embodiment 12: A method of any preceding embodiment, wherein the step of treating the tobacco material with a caustic wash is done at atmospheric pressure Embodiment 13: A method of any preceding embodiment, wherein the bleached tobacco pulp is dried to a moisture content of less than about 30 percent moisture on a wet basis.

Embodiment 14: A method of any preceding embodiment, further comprising dewatering the tobacco material using at least one of a screw press and a basket centrifuge following treating the tobacco material, extracting the tobacco pulp, and/or bleaching the extracted tobacco pulp.

Embodiment 15: A method of any preceding embodiment, wherein the bleaching solution further comprises one or more stabilizers in addition to the oxidizing agent.

Embodiment 16: A method of any preceding embodiment, wherein the bleaching solution further comprises one or more stabilizers in addition to the oxidizing agent, and wherein the stabilizers are selected from the group consisting of magnesium sulfate, sodium silicate, and combinations thereof.

Embodiment 17: A method of any preceding embodiment, further comprising neutralizing the bleached pulp material to a pH in the range of about 5 to about 11 prior to drying the bleached tobacco pulp.

Embodiment 18: A method of any preceding embodiment, further comprising milling the whitened tobacco material following drying the tobacco pulp to a size in the range of approximately 5 mm to about 0.1 mm.

Embodiment 19: A method of any preceding embodiment, wherein the molar ratio of the extraction solution to the tobacco material is in the range of approximately 4:1 to about 16:1.

Embodiment 20: A method of any preceding embodiment, wherein the whitened tobacco material comprises at least about 90% by weight roots, stalks, or a combination thereof.

Embodiment 21: A method of any preceding embodiment, further comprising mixing the extracted tobacco pulp with a wood pulp prior to bleaching the extracted tobacco pulp.

Embodiment 22: A method of any preceding embodiment, further comprising incorporating the whitened tobacco material within a smokeless tobacco product.

Embodiment 23: A method of any preceding embodiment, further comprising incorporating the whitened tobacco material within a smokeless tobacco product, wherein the smokeless tobacco product further comprises one or more additional components selected from the group consisting of flavorants, fillers, binders, pH adjusters, buffering agents, colorants, disintegration aids, antioxidants, humectants, and preservatives.

Embodiment 24: A method of preparing a whitened tobacco material, the method comprising: (i) treating a tobacco material with an extraction solution comprising an acid component to provide a tobacco pulp and a tobacco extract, wherein the tobacco material is treated for a time and at a temperature sufficient to lighten the color of the tobacco pulp to give a whitened tobacco pulp; and (ii) drying the whitened tobacco pulp to provide the whitened tobacco material.

Embodiment 25: A method of any preceding embodiment, wherein the extraction solution is an aqueous solution.

Embodiment 26: A method of any preceding embodiment, wherein the acid component is peracetic acid.

Embodiment 27: A method of any preceding embodiment, wherein the acid component comprises a mineral acid and an oxidizer.

Embodiment 28: A method of any preceding embodiment, wherein the tobacco material is treated at a pressure greater than ambient pressure.

Embodiment 29: A method of any preceding embodiment, wherein the tobacco material is treated at a pH of about 7 or less.

Embodiment 30: A method of any preceding embodiment, wherein the tobacco material is treated at a temperature of at least about 200° C.

Embodiment 31: A method of any preceding embodiment, wherein the whitened tobacco pulp is dried to a moisture content of less than about 30 percent moisture on a wet basis.

Embodiment 32: A method of any preceding embodiment, further comprising milling the whitened tobacco material following drying the whitened tobacco pulp to a size in the range of approximately 5 mm to about 0.1 mm.

Embodiment 33: A method of any preceding embodiment, further comprising incorporating the whitened tobacco material within a smokeless tobacco product.

Embodiment 34: A method of any preceding embodiment, further comprising incorporating the whitened tobacco material within a smokeless tobacco product, wherein the smokeless tobacco product further comprises one or more additional components selected from the group consisting of flavorants, fillers, binders, pH adjusters, buffering agents, colorants, disintegration aids, antioxidants, humectants, and preservatives.

Embodiment 35: A method of preparing a whitened tobacco material, the method comprising: (i) subjecting a tobacco material to hot water extraction for a time and at a temperature and a pressure sufficient to lighten the color of the tobacco material to give a whitened tobacco solids material and a tobacco extract; and (ii) drying the whitened tobacco solids material to provide the whitened tobacco material.

Embodiment 36: A method of any preceding embodiment, wherein the hot water extraction comprises mixing the tobacco material with hot water or steam in a pressurized vessel.

Embodiment 37: A method of any preceding embodiment, wherein the hot water extraction further comprises adding a bleaching agent.

Embodiment 38: A method of any preceding embodiment, wherein the pressure within the pressurized vessel is in the range of about 30 bar to about 50 bar.

Embodiment 39: A method of any preceding embodiment, wherein the temperature within the pressurized vessel is in the range of about 200° C. to about 240° C.

Embodiment 40: A method of any preceding embodiment, wherein the whitened tobacco solids material is dried to a moisture content of less than about 30 percent moisture on a wet basis.

Embodiment 41: A method of any preceding embodiment, further comprising milling the whitened tobacco material following drying the whitened tobacco solids material to a size in the range of approximately 5 mm to about 0.1 mm.

Embodiment 42: A method of any preceding embodiment, further comprising incorporating the whitened tobacco material within a smokeless tobacco product.

Embodiment 43: A method of any preceding embodiment, further comprising incorporating the whitened tobacco material within a smokeless tobacco product, wherein the smokeless tobacco product further comprises one or more additional components selected from the group consisting of flavorants, fillers, binders, pH adjusters, buffering agents, colorants, disintegration aids, antioxidants, humectants, and preservatives.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a particular embodiment description herein. This disclosure is intended to be read holistically such that any separable features or elements of the disclosed invention, in any of its various aspects or embodiments, should be viewed as combinable unless the context clearly dictates otherwise.

DETAILED DESCRIPTION

Aspects of the present disclosure now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

Certain embodiments will be described with reference to FIG. 1 of the accompanying drawings, and these described embodiments involve snus-type products having an outer pouch and containing a whitened tobacco material. As explained in greater detail below, such embodiments are provided by way of example only, and the smokeless tobacco product can include tobacco compositions in other forms.

Figure 1:
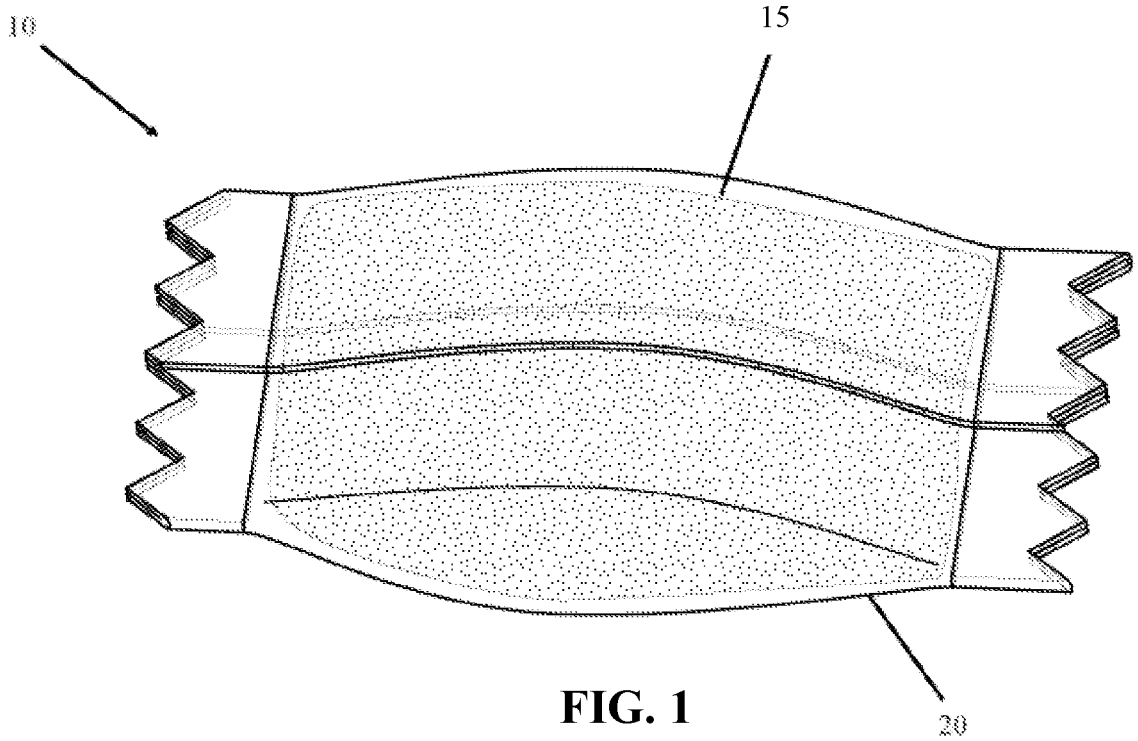
FIG. 1 shows a front perspective view illustrating a pouched product according to an embodiment.

Referring to FIG. 1, there is shown a first embodiment of a smokeless tobacco product 10. The tobacco product 10 includes a moisture-permeable container in the form of a pouch 20, which contains a material 15 comprising a whitened tobacco material of a type described herein.

The smokeless tobacco product also may optionally comprise, in certain embodiments, a plurality of microcapsules dispersed within the material 15, the microcapsules containing a component (e.g., a flavorant) such as described in greater detail below.

The tobacco product 10 is typically used by placing one pouch containing the tobacco formulation in the mouth of a human subject/user. During use, saliva in the mouth of the user causes some of the components of the tobacco formulation to pass through the water-permeable pouch and into the mouth of the user. The pouch preferably is not chewed or swallowed. The user is provided with tobacco flavor and satisfaction, and is not required to spit out any portion of the tobacco formulation. After about 10 minutes to about 60 minutes, typically about 15 minutes to about 45 minutes, of use/enjoyment, substantial amounts of the tobacco formulation and the contents of the optional microcapsules and have been absorbed (via either gingival or buccal absorption) by the human subject, and the pouch may be removed from the mouth of the human subject for disposal. In certain embodiments, the pouch materials can be designed and manufactured such that under conditions of normal use, a significant amount of the tobacco formulation contents permeate through the pouch material prior to the time that the pouch undergoes loss of its physical integrity.

Preparation of Tobacco Materials Prior to Whitening

The present disclosure provides whitened tobacco compositions, smokeless tobacco products incorporating such whitened tobacco compositions, and methods for preparing a whitened tobacco composition and for incorporating such compositions within smokeless tobacco products. As used herein, the term "whitened" refers to a composition comprising a tobacco material that has been treated to remove some degree of color therefrom. Thus, a "whitened" tobacco material that is treated according to the methods described herein is visually lighter in hue than an untreated tobacco material. The whitened tobacco composition of the invention can be used as a component of a smokeless tobacco composition, such as loose moist snuff, loose dry snuff, chewing tobacco, pelletized tobacco pieces, extruded or formed tobacco strips, pieces, rods, or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips, or capsule-like materials.

Tobaccos used in the tobacco compositions of the invention may vary. In certain embodiments, tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos and various blends of any of the foregoing tobaccos. Descriptions of various types of tobaccos, growing practices and harvesting practices are set forth in *Tobacco Production, Chemistry and Technology*, Davis et al. (Eds.) (1999), which is incorporated herein by reference. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference. Example *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N.* x *sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *hersperis, N. pauciflora, N. petunioides, N. quadrivalvis, N. repanda, N. rotundifolia, N. solanifolia*, and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO 2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference. Most preferably, the tobacco materials are those that have been appropriately cured and aged. Especially preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference. Certain types of unusual or rare tobaccos can be sun cured. Manners and methods for improving the smoking quality of Oriental tobaccos are set forth in U.S. Pat. No. 7,025,066 to Lawson et al., which is incorporated herein by reference. Representative Oriental tobaccos include katerini, prelip, komotini, xanthi and yambol tobaccos. Tobacco compositions including dark air cured tobacco are set forth in US Patent Appl. Pub. No. 2008/0245377 to Marshall et al., which is incorporated herein by reference. See also, types of tobacco as set forth, for example, in US Patent Appl. Pub. No. 2011/0247640 to Beeson et al., which is incorporated herein by reference.

The *Nicotiana* species can be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., *Galpao commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be employed. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In some embodiments, the tobacco material subjected to the treatments set forth herein is *Rustica* stems in milled form.

The post-harvest processing of the plant or portion thereof can vary. After harvest, the plant, or portion thereof, can be used in a green form (e.g., the plant or portion thereof can be used without being subjected to any curing process). For example, the plant or portion thereof can be used without being subjected to significant storage, handling or processing conditions. In certain situations, it is advantageous for the plant or portion thereof be used virtually immediately after harvest. Alternatively, for example, a plant or portion thereof in green form can be refrigerated or frozen for later use, freeze dried, subjected to irradiation, yellowed, dried, cured (e.g., using air drying techniques or techniques that employ application of heat), heated or cooked (e.g., roasted, fried or boiled), or otherwise subjected to storage or treatment for later use.

The harvested plant or portion thereof can be physically processed. The plant or portion thereof can be separated into individual parts or pieces (e.g., the leaves can be removed from the stems, and/or the stems and leaves can be removed from the stalk). The harvested plant or individual parts or pieces can be further subdivided into parts or pieces (e.g., the leaves can be shredded, cut, comminuted, pulverized, milled or ground into pieces or parts that can be characterized as filler-type pieces, granules, particulates or fine powders). The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground or milled pieces of plants or portions thereof can have moisture contents of less than about 25 weight percent, often less than about 20 weight percent, and frequently less than about 15 weight percent.

Tobacco compositions intended to be used in a smokeless form such as that in FIG. 1 may incorporate a single type of tobacco (e.g., in a so-called "straight grade" form). For example, the tobacco within a tobacco composition may be composed solely of flue-cured tobacco (e.g., all of the tobacco may be composed, or derived from, either flue-cured tobacco lamina or a mixture of flue-cured tobacco lamina and flue-cured tobacco stem). In one embodiment, the tobacco comprises or is composed solely of sun-cured milled *Rustica* stems (i.e., *N. rustica* stems). The tobacco within a tobacco composition also may have a so-called "blended" form. For example, the tobacco within a tobacco composition of the present invention may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem).

Portions of the tobaccos within the tobacco product may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the tobacco product optionally may incorporate tobacco that has been fermented. See, also, the types of tobacco processing techniques set forth in PCT WO 05/063060 to Atchley et al., which is incorporated herein by reference.

In certain embodiments, the starting tobacco material can include tobacco stems. As used herein, "stem" refers to the long thing part of a tobacco plant from which leaves or flowers grow, and can include the leaves, lamina, and/or flowers. In some embodiments, it can be advantageous to use stalks and/or roots of the tobacco plant. The tobacco stalks and/or roots can be separated into individual pieces (e.g., roots separated from stalks, and/or root parts separated from each other, such as big root, mid root, and small root parts) or the stalks and roots may be combined. By "stalk" is meant the stalk that is left after the leaf (including stem and lamina) has been removed. "Root" and various specific root parts useful according to the present invention may be defined and classified as described, for example, in Mauseth, Botany: An Introduction to Plant Biology: Fourth Edition, Jones and Bartlett Publishers (2009) and Glimn-Lacy et al., Botany Illustrated, Second Edition, Springer (2006), which are incorporated herein by reference. The harvested stalks and/or roots are typically cleaned, ground, and dried to produce a material that can be described as particulate (i.e., shredded, pulverized, ground, granulated, or powdered). As used herein, stalks and/or roots can also refer to stalks and/or roots that have undergone an extraction process to remove water soluble materials. The cellulosic material (i.e., pulp) remaining after stalks and/or root materials undergo an extraction process can also be useful in the present invention.

Although the tobacco material may comprise material from any part of a plant of the *Nicotiana* species, in certain embodiments, the majority of the material can comprise material obtained from the stems, stalks and/or roots of the plant. For example, in certain embodiments, the tobacco material comprises at least about 90%, at least about 92%, at least about 95%, or at least about 97% by dry weight of at least one of the stem material, the stalk material and the root material of a harvested plant of the *Nicotiana* species.

The tobacco material used in the present invention is typically provided in a shredded, ground, granulated, fine particulate, or powder form. As illustrated at operation 100 of FIGS. 2-4, the tobacco whitening processes described herein can include optionally milling a tobacco material. Most preferably, the tobacco is employed in the form of parts or pieces that have an average particle size less than that of the parts or pieces of shredded tobacco used in so-called "fine cut" tobacco products. Typically, the very finely divided tobacco particles or pieces are sized to pass through a screen of about 18 or 16 U.S. sieve size, generally are sized to pass a screen of about 20 U.S. sieve size, often are sized to pass through a screen of about 50 U.S. sieve size, frequently are sized to pass through a screen of about 60 U.S. sieve size, may even be sized to pass through a screen of 100 U.S. sieve size, and further may be sized so as to pass through a screen of 200 U.S. sieve size. It is noted that two scales commonly used to classify particle sizes are the U.S. Sieve Series and Tyler Equivalent. Sometimes these two scales are referred to as Tyler Mesh Size or Tyler Standard Sieve Series. U.S. sieve size is referred to in the present application. If desired, air classification equipment may be used to ensure that small sized tobacco particles of the desired sizes, or range of sizes, may be collected. In one embodiment, the tobacco material is in particulate form sized to pass through an 18 or 16 U.S. sieve size, but not through a 60 U.S. sieve size. If desired, differently sized pieces of granulated tobacco may be mixed together. Typically, the very finely divided tobacco particles or pieces suitable for snus products have a particle size greater than −8 U.S. sieve size, often −8 to +100 U.S. sieve size, frequently −16 to +60 U.S. sieve size. In certain embodiments, the tobacco is provided with an average particle size of about 0.2 to about 2 mm, about 0.5 to about 1.5 mm, about 0.2 to about 1.0 mm, or about 0.75 to about 1.25 mm (e.g., about 1 mm).

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent. The tobacco material can be processed to provide it in the desired form before and/or after being subjected to any of the alternative whitening methods described further herein below.

In some embodiments, the type of tobacco material that is treated (i.e., subjected to the processes described herein) is selected such that it is initially visually lighter in color than other tobacco materials to some degree. Accordingly, one optional step of the method described herein comprises screening various tobacco materials and selecting one or more of the tobacco materials based on their visual appearance (i.e., their "lightness," or "whiteness"). Where conducted, this screening step can, in some embodiments, comprise a visual screening wherein certain tobacco materials (e.g., certain tobacco types) are selected that are visually lighter in hue than other tobacco materials. In some embodiments, the screening can be conducted by means of an automated operation that selects certain tobacco materials based on predetermined characteristics (e.g., having a lightness above a given threshold value). For example, optical instruments (e.g., spectrophotometer/spectroreflectometer) and/or optical sorting equipment can be used for this purpose. Such equipment is available, for example, from Autoelrepho® Products, AZ Technology, Hunter Lab, X-Rite, SpecMetrix, and others.

Alternative Whitening Method 1

In one aspect of the present disclosure a method of whitening a tobacco material is provided, the method comprising: treating a tobacco material with a caustic wash to form a tobacco pulp; extracting the tobacco pulp with an extraction solution to provide an extracted tobacco pulp and a tobacco extract; bleaching the extracted tobacco pulp with a solution comprising an oxidizing agent to provide a bleached tobacco pulp; and drying the bleached tobacco pulp to provide a whitened tobacco material. In preferred embodiments of this aspect of the invention, the starting tobacco materials may preferably comprise tobacco lamina, stems, stalks, roots, and combinations thereof. In various embodiments, the whitening process can further include one or more treatments with a solution comprising a strong base, an oxidizing agent, or a combination thereof prior to the step of drying the bleached tobacco pulp.

As noted above, a chemical pulping process can be used to pulp and delignify the tobacco biomass at operation 100. A chemical pulping process separates lignin from cellulose fibers by dissolving lignin in a cooking liquor such that the lignin, which binds the cellulose fibers together, can be washed away from the cellulose fibers without seriously degrading the cellulose fibers. There are three main chemical pulping processes known in the art. Soda pulping involves cooking raw material chips in a sodium hydroxide cooking liquor. The kraft process evolved from soda pulping and involves cooking raw material chips in a solution of sodium hydroxide and sodium sulfide. The acidic sulfite process involves using sulfurous acid and bisulfate ion in the cook. The kraft process is the most commonly used method for chemical wood pulping; however, the soda process can also be used to produce some hardwood pulps. Any chemical pulping process, including, but not limited to the three examples listed above, can be used to produce a tobacco pulp from raw tobacco materials.

A cooking liquor can comprise a strong base. As used herein, a strong base refers to a basic chemical compound (or combination of such compounds) that is able to deprotonate very weak acids in an acid-base reaction. For example, strong bases that can be useful in the present invention include, but are not limited to one or more of sodium hydroxide, potassium hydroxide, sodium carbonate, sodium bicarbonate, potassium carbonate, potassium bicarbonate, ammonium hydroxide, ammonium bicarbonate, and ammonium carbonate. In some embodiments, the weight of the strong base can be greater than about 5%, greater than about 25%, or greater than about 40% of the weight of the tobacco input. In certain embodiments, the weight of the strong base can be less than about 60% or less than about 50% of the weight of the tobacco input. In still further embodiments, the weight of the strong base can be from about 5% to about 50%, or from about 30% to about 40% of the weight of the tobacco input. Various other chemicals and weight ratios thereof can also be employed to chemically pulp the tobacco input in other embodiments.

In some embodiments of the present disclosure, it may be preferable to use the soda pulping process to produce tobacco pulps as described herein from various starting tobacco materials. In some embodiments, a tobacco input comprising tobacco lamina, stems, roots, and combinations thereof can be mixed in a digester with water and a strong base (such as sodium hydroxide) prior to subjecting the mixture to the soda pulping process. In addition to combining a tobacco input with water and a strong base, chemically pulping a tobacco input can include heating the tobacco input and the strong base at high temperatures and pressures in the digester. Heating the tobacco input and the strong base can be conducted to increase the efficacy of the chemical pulping. In this regard, an increase in either cooking temperature or time will result in an increased reaction rate (rate of lignin removal).

In some embodiments, the tobacco input and the strong base can be heated to a maximum temperature from about 140° C. to about 200° C., or to about 150° C. to about 170° C., or to about 155° C. to about 165° C. In some embodiments, the tobacco input and the strong base can be heated to a temperature of at least about 140° C., at least about 150° C., or at least about 160° C. In some embodiments, the tobacco input and the strong base can be heated to a temperature of about 160° C.

In some embodiments, the tobacco input and the strong base can be heated for a period of time in the range of about 30 minutes to about 90 minutes, or about 40 to about 80 minutes, or about 50 to about 70 minutes. In some embodiments, the maximum temperature during chemical pulping can be sustained for at least about 10 minutes, at least about 20 minutes, at least about 30 minutes, or at least about 40 minutes. In certain embodiments, the tobacco input can be heated at the maximum temperature for about 60 minutes.

As is known in the art, chemical pulping processes can be described in terms of a parameter called the H-factor, which takes into account both the temperature and the time of chemical pulping. See, e.g., the discussion of H-factor calculations provided in U.S. Pat. No. 9,339,058 to Byrd Jr. et al., which is incorporated herein by reference in its entirety. The equation for calculating an H-factor is provided below:

$$H=\int_0^t \exp(43.2-16115/T)dt, \quad \text{(Equation 1)}$$

wherein:

T=temperature (in Kelvin), and t=time (in minutes).

In some embodiments, heating the tobacco input and the strong base at operation 100 can be conducted with an H-factor of at least about 500, at least about 1,000, or at least about 1,500, or at least about 2,000. In some embodiments, the tobacco input and the strong base can be heated with an H-factor from about 500 to about 3,300, or from about 800 to about 3,000, or from about 1,200 to about 2,000. In some embodiments, the tobacco input and the strong base can be heated with an H-factor of 1,600.

Chemical pulping of the tobacco input may be conducted in a pressurized vessel. In some embodiments, the chemical pulping step may further include agitating the tobacco input in the vessel. In some embodiments, the method of producing a tobacco-derived pulp can include one or more additional operations. See, e.g., U.S. Patent Appl. Pub. No. 2013/0276801 to Byrd Jr. et al., herein incorporated by reference in its entirety. For example, the tobacco input can undergo further processing steps prior to pulping and/or the delignification method can include additional treatment steps (e.g., drying the tobacco input, or depithing the tobacco input). In some embodiments, these additional steps can be conducted to remove pith (which comprises lignin) from the tobacco input and/or tobacco pulp manually, and thus reduce the amount of chemicals necessary to delignify the tobacco input during a chemical pulping process, for example. Mixing water with the tobacco pulp to form a slurry and filtering the slurry can be conducted, for example, to remove certain materials, such as pith, parenchyma, and tissue from the tobacco pulp. Anthraquinone can be employed in a chemical pulping method in an attempt to provide a higher yield by protecting carbohydrates from the strong base during delignification, for example. Other processing steps known in the pulping and delignification field can be employed in forming tobacco pulp from the raw tobacco input. After the chemical pulping step is carried out, the cooking liquor is drained from the cooked tobacco input to provide a tobacco pulp slurry.

Figure 2:
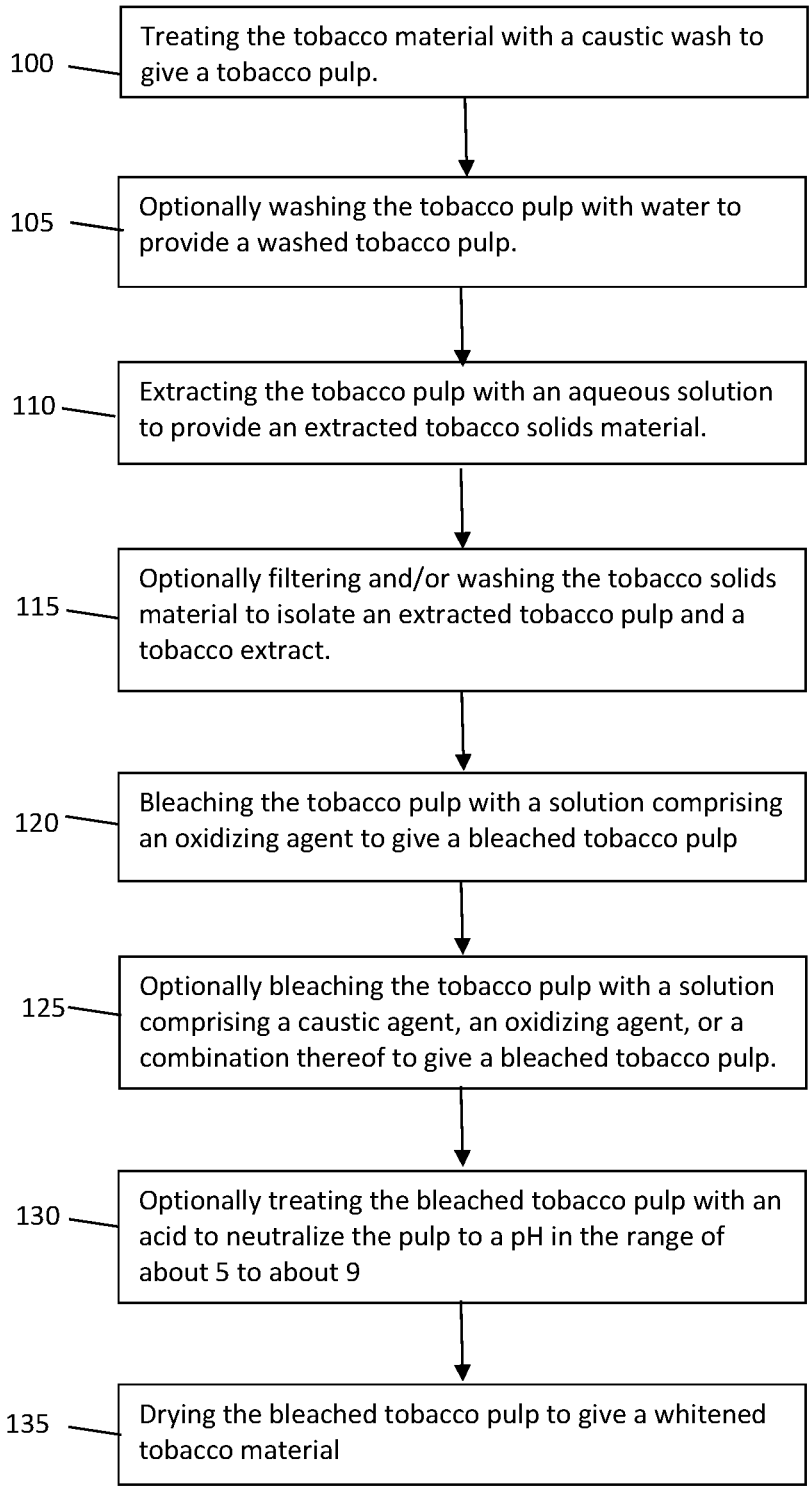
FIG. 2 is a flow chart illustrating the general steps for preparing a whitened tobacco material using a first method of whitening tobacco, according to an example embodiment of the present disclosure.

As illustrated in FIG. 2, for example, following the chemical pulping step at operation 100, the tobacco pulp slurry, from which the cooking liquor is drained, can be optionally washed with water at operation 105. In such embodiments, the tobacco pulp slurry can be washed with water to further remove various soluble or undesired components from the pulp slurry to give a washed tobacco pulp. Following the pulping step and, if used, the optional wash step, the washed tobacco pulp can be subsequently subjected to an extraction step. As illustrated in FIG. 2, this extraction step can comprise a solvent extraction at operation 110 comprising contacting the tobacco material with a solvent (e.g., water) for a time and at a temperature sufficient to cause the extraction of one or more components of the tobacco material into the solvent, and separating the extract from the residual tobacco solid material. "Tobacco solid material" (also referred to as "extracted tobacco pulp) as used herein is the solid, residual tobacco material that remains after the liquid component (i.e., tobacco extract) is removed from the material in step 115. "Tobacco extract" as used herein refers to the isolated components of a tobacco material that are extracted from solid tobacco material by a solvent that is brought into contact with the tobacco material in an extraction process in step 115.

Various extraction techniques of tobacco materials can be used to provide a tobacco extract and tobacco solid material. See, for example, the extraction processes described in US Pat. Appl. Pub. No. 2011/0247640 to Beeson et al., which is incorporated herein by reference. Other example techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein. In certain embodiments, the solvent is added to the tobacco material and the material is soaked for a given period of time (e.g., about 1 h); the extraction product is then filtered to give a tobacco solid material and the solvent and any solubles contained therein are filtered off to give a tobacco extract.

The solvent used for extraction of the tobacco material can vary. For example, in some embodiments, the solvent comprises a solvent having an aqueous character, such as distilled water and/or tap water. In some embodiments, hot water extraction can be used. See, e.g., Li et al, Bioresources, 8(4), 2013 (URL: https://ojs.cnr.ncsu.edu/index.php/BioRes/article/view/BioRes_08_4_5690_Li_Extraction_Hemicellulose_Aspen). In some embodiments, the solvent can have one or more additives and may contain, for example, organic and/or inorganic acids, bases, or salts, pH buffers, surfactants, or combinations thereof and may comprise minor amounts of one or more organic solvents (e.g., various alcohols, polyols, and/or humectants). The tobacco material extraction step may be carried out under acidic, neutral, or basic conditions. See, e.g., Huang et al, Bioresources, 14(3), 2019 (URL: https://ojs.cnr.ncsu.edu/index.php/BioRes/article/view/BioRes_14_3_5544_Huang_Production_Dissolving_Grade_Pulp_Tobacco); particularly p 5548 which suggests a range of extraction conditions may be effective in removing extractives from tobacco material. In other embodiments, the solvent can comprise an organic solvent, such as an alcohol (e.g., ethanol, isopropanol, etc.), which can be used alone or in combination with an aqueous solvent. Hemicellulase, cellulase, or other enzymatic treatment may be employed in the tobacco material extraction step.

In various embodiments, the tobacco pulp slurry can be extracted with a solvent (e.g., water) and at least one chelating agent which is capable of removing transition metals from the tobacco pulp to provide an extracted tobacco pulp and a tobacco extract. Various chelating agents (sometimes referred to as "sequestrants") are useful to remove certain metals from the tobacco pulp that could cause yellowing, and thus interfere with the whitening process. Suitable chelating agents may include, but are not limited to, EDTA, EGTA, HEDTA, DTPA, NTA, calcium citrate, calcium diacetate, calcium hexametaphosphate, citric acid, gluconic acid, dipotassium phosphate, disodium phosphate, isopropyl citrate, monobasic calcium phosphate, monoisopropyl citrate, potassium citrate, sodium acid phosphate, sodium citrate, sodium gluconate, sodium hexametaphosphate, sodium metaphosphate, sodium phosphate, sodium pyrophosphate, sodium tripolyphosphate, stearyl citrate, tetra sodium pyrophosphate, calcium disodium ethylene diamine tetra-acetate, glucono delta-lactone, potassium gluconate and the like, and their analogs, homologs and derivatives; as described in U.S. Pat. No. 9,321,806 to Lo et al., which has been incorporated by reference herein in its entirety. For example, the tobacco pulp can be extracted with an aqueous solution comprising ethylenediaminetetraacetic acid (EDTA). In some embodiments, the chelating agent can comprise diethylenetriamine pentaacetic acid (DTPA). In various embodiments, the chelating agent(s) can be present in an amount of about 0.01 to about 5.0 dry weight percent, about 0.1 to about 2.0 dry weight percent, about 0.5 to about 1.5 dry weight percent, or about 0.7 to about 1.0 dry weight percent, based on the total dry weight of the tobacco material.

Typically, the extraction comprises adding a large excess of one or more solvents, which may further include at least one chelating agent as described above, to the tobacco material so as to produce a slurry (comprising, for example, 50-90% by weight of the solvent), although the amount of solvent can vary. The water used to form the moist material can be pure water (e.g., tap water or deionized water) or a mixture of water with suitable co-solvents such as certain alcohols. In certain embodiments, the amount of water added to form the moist material can be at least about 50 weight percent, or at least about 60 weight percent, or at least about 70 weight percent, based on the total weight of the moist material. In some cases, the amount of water can be described as at least about 80 weight percent or at least about 90 weight percent.

In some preferred embodiments, the tobacco material can be combined with water to form a moist aqueous material (e.g., in the form of a suspension or slurry) and the resulting material can be heated to effectuate extraction of various compounds. The solvent can be at room temperature or at an elevated temperature. For example, the solvent can be heated at a temperature of between about room temperature and about 120° C., or about room temperature and about 110° C. (e.g., about 100° C., about 80° C., about 60° C., about 40° C., or about 20° C.). In some embodiments the aqueous tobacco pulp may be held at a temperature of between about 50° C. and about 100° C., or about 60° C. to about 90° C., or about 70° C. to about 80° C. In some embodiments, the aqueous tobacco pulp may be held at a temperature of at least about 20° C., or at least about 40° C., or at least about 60° C., or at least about 80° C.

The amount of time for which the tobacco material remains in contact with the extraction solvent can vary. For example, in some embodiments, the tobacco material is in contact with the solvent for about thirty minutes to about six hours (e.g., about 1 hour, about 2 hours, about 3 hours, about 4 hours, about 5 hours, or about 6 hours), although shorter and longer time periods can be used. In some embodiments, the extraction time period at least about 10 minutes, at least about 20 minutes, at least about 30 minutes or at least about 1 hour. In certain embodiments, the time period is a period of no more than about 4 hours, no more than about 2 hours, or no more than about 1 hour. The amount of time can depend, for example, on the temperature of the solvent. For example, less time may be required to extract the tobacco material using solvent at a higher temperature than that required to extract the tobacco material with room temperature or cold solvent. In certain preferred embodiments, the tobacco pulp remains in contact with the extraction solvent for a time period of up to an hour and at a temperature of about 80° C.

The number of extraction steps can vary. For example, in certain embodiments, the tobacco material is extracted one or more times, two or more times, three or more times, four or more times, or five or more times. The solvent used for each extraction can vary. For example, in one particular embodiment, one or more extractions are conducted using hot water; and in a final extraction, the extraction is conducted using a basic solution (e.g., a 5% NaOH solution). After each extraction step, the extracted tobacco pulp is filtered and the solvent and solubles are removed from the extracted tobacco pulp. In certain embodiments, the extracts obtained from each extraction can be combined and clarified, as described in U.S. Pat. No. 9,420,825 to Beeson et al., which is herein incorporated by reference in its entirety. In other embodiments, some extracts are discarded, such as extracts from later stages. In such embodiments, for example, it may be desirable in some embodiments to use only the tobacco extract obtained from a first extraction of a tobacco material or to combine tobacco extracts obtained from a first and second extraction of a tobacco material.

Following the extraction process, the extracted tobacco pulp is generally isolated from the tobacco extract, as illustrated at operation 115 of FIG. 2, for example, by filtration or centrifugation, although these methods are not intended to be limiting. Alternatively, in some embodiments, the extracted tobacco pulp can be isolated from the extract by means of distillation (e.g., steam distillation) of the tobacco mixture (e.g., the tobacco slurry). The process of filtration can comprise passing the liquid through one or more filter screens to remove selected sizes of particulate matter. Screens may be, for example, stationary, vibrating, rotary, or any combination thereof. Filters may be, for example, press filters or pressure filters. In some embodiments, the filtration method used can involve microfiltration, ultrafiltration, and/or nanofiltration. A filter aid can be employed to provide effective filtration and can comprise any material typically used for this purpose. For example, some common filter aids include cellulose fibers, perlite, bentonite, diatomaceous earth, and other silaceous materials. To remove solid components, alternative methods can also be used, for example, centrifugation or settling/sedimentation of the components and siphoning off of the liquid. See, for example, the processes and products described in U.S. Pat. App. Pub. Nos. 2012/0152265 to Dube et al. and 2012/0192880 to Dube et al., herein incorporated by reference in their entireties.

The extracted tobacco pulp that has been provided following the pulping and extraction steps is bleached (i.e., whitened) using a bleaching solution comprising. It is noted that in certain embodiments, a combination of extracted tobacco pulp and wood pulp may undergo a whitening step or any other process step described herein; however, for convenience, the following description refers only to tobacco pulp. Processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 3,943,945 to Rosen; U.S. Pat. No. 4,143,666 to Rainer; U.S. Pat. No. 4,194,514 to Campbell; U.S. Pat. Nos. 4,366,823, 4,366,824, and 4,388,933 to Rainer et al.; U.S. Pat. No. 4,641,667 to Schmekel et al.; and U.S. Pat. No. 5,713,376 to Berger; and PCT WO 96/31255 to Giolvas, all of which are incorporated herein by reference. Other whitening methods using reagents such as ozone and potassium permanganate can also be used. See, for example, U.S. Pat. No. 3,943,940 to Minami, which is incorporated herein by reference.

In some embodiments, the extracted tobacco pulp is bleached with a bleaching solution comprising at least one oxidizing agent to provide a bleached tobacco pulp. Example oxidizing agents include, but are not limited to, peroxides (e.g., hydrogen peroxide), chlorite salts, chlorate salts, perchlorate salts, hypochlorite salts, ozone, ammonia, and combinations thereof. For example, the extracted tobacco pulp may be treated with hydrogen peroxide or other oxidizing agents and water to form a tobacco pulp slurry. In various embodiments, the oxidizing agent (i.e., oxidant or oxidizer) can be any substance that readily transfers oxygen atoms and/or gains electrons in a reduction/oxidation (redox) chemical reaction. Peroxides (e.g., hydrogen peroxide, peracetic acid) are preferred oxidizing agents; however, the bleaching solution can include any oxidizing reagent, including, but not limited to: other oxides (including nitrous oxide, silver oxide, chromium trioxide, chromate, dichromate, pyridinium chlorochromate; and osmium tetroxide); oxygen ($O_2$); ozone ($O_3$); fluorine ($F_2$); chlorine ($Cl_2$); and other halogens; hypochlorite, chlorite, chlorate, perchlorite, and other halogen analogues thereof; nitric acid; nitrate compounds; sulfuric acid; persulfuric acids; hydroxyl radicals; manganate and permanganate compounds (e.g., potassium permanganate); sodium perborate; 2,2'-diphyridyldisulfide; and combinations thereof. Peroxide activators such as TAED (tetraacetylethylenediamine) which generates in situ peracetic acid may be used in the peroxide bleaching stage. See, e.g., URLs: https://www.tappi.org/content/events/07recycle/presentation/hsieh.pdf, Zhao et al, Bioresources, 5(1), 276-210, 2010, https://pdfs.semanticscholar.org/8e78/9d93d8cc673e2f13b8daee35e3477c51b3fe.pdf.

The bleaching solution can optionally include one or more oxidizing catalysts. Example oxidation catalysts are titanium dioxide, manganese dioxide, and combinations thereof. In certain preferred embodiments, the oxidizing reagent used according to the invention is chlorine-free. In certain embodiments, the oxidizing reagent is provided in aqueous solution form. The amount of oxidizing agent used in the methods of the present invention can vary. For example, in certain embodiments, the oxidizing agent is provided in a weight amount of about 0.1 to fifty times the weight of the (dry) tobacco solids material. For example, in some embodiments, the oxidizing agent is provided in a weight amount about equal to the weight of the (dry) tobacco solids material, about 0.25 times the weight of the (dry) tobacco solids material, about 0.5 times the weight of the (dry) tobacco solids material, about 0.7 times the weight of the (dry) tobacco solids material, about 1.0 times the weight of the (dry) tobacco solids material, about 1.25 times the weight of the (dry) tobacco solids material, about 1.5 times the weight of the (dry) tobacco solids material, about 2 times the weight of the (dry) tobacco solids material, or about 5 times the weight of the (dry) tobacco solids material. In some embodiments, the oxidizing agent is provided in a weight amount in the range of about 0.1 to about 5 times the weight of the (dry) tobacco solids material, about 0.2 to about 2.5 times the weight of the (dry) tobacco solids material, about 0.25 to about 1.5 times the weight of the (dry) tobacco solids material, about 0.5 to about 1.0 times the weight of the (dry) tobacco solids material, or about 0.7 to about 0.9 times the weight of the (dry) tobacco solids material. Different oxidizing agents can have different application rates. In certain embodiments wherein the oxidizing agent comprises hydrogen peroxide, the bleaching solution can comprise hydrogen peroxide in a weight of about 0.25-1.5 times the weight of the dry tobacco solids material.

The solids content of the oxidative bleaching stage may be adjusted. Without being limited by theory, higher solids content may be beneficial and result in the need for less oxidative bleaching agent to achieve a target whiteness (or brightness). For example, in certain embodiments, the bleaching solution can include about 0.7-0.9 times more oxidizing agent than dry tobacco material (at about 10% solids), about 1.0 times more oxidizing agent than dry tobacco material (at about 4.5% solids). In some embodiments, a >25% solids content may be beneficial. See, e.g., https://www.valmet.com/pulp/mechanical-pulping/bleaching/bleach-tower/; https://www.valmet.com/pulp/mechanical-pulping/bleaching/high-consistency-bleaching-phc/). The percentage of solids during bleaching can vary and can have an impact on the effectiveness of the bleaching operation. The solids percentage is calculated using the following formula:

$$\text{Solids (\%)}=100\times(\text{wt. dry tobacco})/(\text{wt. dry tobacco}+\text{wt. water}+\text{wt. oxidizing agent})$$

In various embodiments, the percentage of solids can be in the range of about 1-20%, about 3-15%, or about 3-10%. In some embodiments, the percentage of solids can be in the range of about 2-5%, or about 8-12%. The percentage of solids can be, for example, at least about 2%, at least about 3%, at least about 4%, at least about 5%, or at least about 10%.

In various embodiments, the bleaching process can further include treatment with one or more stabilizers in addition to an oxidizing agent. For example, the stabilizer can be selected from the group consisting of magnesium sulfate, sodium silicate, and combinations thereof. In various embodiments, the stabilizer(s) can be present in an amount of about 0.01 to about 3.0 dry weight percent, about 0.1 to about 2.5 dry weight percent, or about 0.5 to about 2.0 dry weight percent, based on the total dry weight of the tobacco material pulp.

According to the invention, the extracted tobacco pulp slurry is brought into contact with the oxidizing agent (e.g., hydrogen peroxide) for a period of time. The time for which the tobacco pulp slurry is contacted with the oxidizing agent can vary. For example, in certain embodiments, the time for which the tobacco pulp is contacted with the oxidizing agent is that amount of time sufficient to provide a bleached tobacco pulp with a lightened color as compared to an unbleached tobacco pulp. In certain embodiments, the extracted tobacco pulp is contacted with the oxidizing agent overnight. Normally, the time period is a period of at least about 10 minutes, typically at least about 20 minutes, more often at least about 30 minutes. In certain embodiments, the time period is a period of no more than about 10 hours, no more than about 8 hours, no more than about 6 hours, no more than about 4 hours, no more than about 2 hours, or no more than about 1 hour.

In certain embodiments, the tobacco pulp slurry can be heated during treatment with the oxidizing agent. Generally, heating the tobacco pulp accelerates the whitening process. Where the extracted tobacco pulp is heated during treatment, sufficient color lightening is typically achieved in less time than in embodiments wherein the tobacco pulp is unheated during treatment. The temperature and time of the heat treatment process will vary, and generally, the length of the heat treatment will decrease as the temperature of the heat treatment increases. In certain embodiments, the mixture of tobacco pulp and an oxidizing agent can be heated at a temperature of between room temperature and about 100° C. (e.g., about 90° C. or about 80° C.). Preferably, the mixture is heated between room temperature and about 75° C. The heating, where applicable, can be accomplished using any heating method or apparatus known in the art. The heating can be carried out in an enclosed vessel (e.g., one providing for a controlled atmospheric environment, controlled atmospheric components, and a controlled atmospheric pressure), or in a vessel that is essentially open to ambient air. The temperature can be controlled by using a jacketed vessel, direct steam injection into the tobacco, bubbling hot air through the tobacco, and the like.

In certain embodiments, the heating is performed in a vessel also capable of providing mixing of the composition, such as by stirring or agitation. Example mixing vessels include mixers available from Scott Equipment Company, Littleford Day, Inc., Lödige Process Technology, and the Breddo Likwifier Division of American Ingredients Company. Examples of vessels which provide a pressure controlled environment include high pressure autoclaves available from Berghof/America Inc. of Concord, California, and high pressure reactors available from The Parr Instrument Co. (e.g., Parr Reactor Model Nos. 4522 and 4552 described in U.S. Pat. No. 4,882,128 to Hukvari et al.). The pressure within the mixing vessel during the process can be atmospheric pressure or elevated pressure (e.g., about 10 psig to about 1,000 psig).

In other embodiments, the heating process is conducted in a microwave oven, a convection oven, or by infrared heating. Atmospheric air, or ambient atmosphere, is the preferred atmosphere for carrying out the optional heating step of the present invention. However, heating can also take place under a controlled atmosphere, such as a generally inert atmosphere. Gases such as nitrogen, argon and carbon dioxide can be used. Alternatively, a hydrocarbon gas (e.g., methane, ethane or butane) or a fluorocarbon gas also can provide at least a portion of a controlled atmosphere in certain embodiments, depending on the choice of treatment conditions and desired reaction products.

Following the bleaching step at operation 120, the bleached tobacco pulp can optionally undergo one or more additional bleaching steps. As illustrated in step 125 of FIG. 2, for example, the bleached tobacco pulp can be bleached (i.e., whitened) according to any means known in the art. In certain embodiments of the present invention, tobacco material is bleached using a caustic reagent and/or an oxidizing agent. In some embodiments, the tobacco solids material is whitened using both a caustic reagent and an oxidizing agent. In such embodiments, the caustic reagent and oxidizing agent can be provided separately or can be combined. In various embodiments, these additional bleaching steps can further include treatment with one or more stabilizers, such as those discussed above, in addition to an oxidizing agent. Stepwise addition of a strong base and/or bleaching agent may be used in the bleaching stage. See, e.g., Zhao et al, Bioresources, 5(1), 276-210, 2010; URL: https://pdfs.semanticscholar.org/8e78/9d93d8cc673e2f13b8daee35e3477c51b3fe.pdf; Sun, Hou, Journal of Bioresources and Bioproducts, 3(1), 35-39, 2018; URL: http://www.bioresources-bioproducts.com/index.php/bb/article/view/110/109. As discussed above with regard to the initial bleaching step, in certain embodiments, the bleached tobacco pulp can be heated during treatment with the caustic reagent and/or oxidizing agent in the additional bleaching steps. In certain embodiments, multiple bleaching stages may be applied after the initial bleaching stage.

If both a caustic reagent and an oxidizing reagent are used, the weight ratio of the caustic reagent to oxidizing agent can vary. In certain embodiments where the caustic reagent is NaOH and the oxidizing agent is hydrogen peroxide, the weight ratio of NaOH to hydrogen peroxide is from about 1:1 to about 1:100, preferably from about 1:5 to about 1:50, and more preferably from about 1:10 to about 1:25. In one particular embodiment, the weight ratio of NaOH to hydrogen peroxide is between about 1:20 and about 1:25. These ratios are not limited to ratios of NaOH and hydrogen peroxide and could also be applicable to other caustic reagent and oxidizing agent combinations.

The oxidizing agent (i.e., oxidant or oxidizer) in any subsequent bleaching steps can include any substance that readily transfers oxygen atoms and/or gains electrons in a reduction/oxidation (redox) chemical reaction, such as those mentioned previously in the prior bleaching step above. The caustic extraction step may include one or more caustic reagents. Caustic reagents can vary and can be, for example, any strong base, including but not limited to, an alkaline metal hydroxide, alkaline earth metal hydroxide, or mixture thereof. In certain example embodiments, the caustic reagent is sodium hydroxide or potassium hydroxide. Alternative reagents that can be used include, but are not limited to, ammonium hydroxide, sodium carbonate, potassium carbonate, ammonia gas, and mixtures thereof. The caustic reagent is generally provided in solution form (e.g., in aqueous solution) and the concentration of the caustic reagent in the solution can vary. Also, the amount of caustic reagent used in the methods of the present invention can vary. For example, in certain embodiments, the caustic reagent is provided in an amount of between about 1% and about 50% dry weight basis (e.g., between about 1% and about 40% or between about 1% and about 30%) by weight of the (dry) tobacco pulp. For example, the caustic reagent can be provided in an amount of about 2%, about 5%, about 7%, about 10%, or about 25% by weight of the (dry) tobacco pulp. It is noted that the quantity of caustic reagent required may, in certain embodiments, vary as a result of the strength of the caustic reagent. For example, more caustic reagent may, in some embodiments, be required where the caustic reagent is a weaker base, whereas less caustic reagent may, in some embodiments, be required where the caustic reagent is a strong base.

The time for which the bleached tobacco pulp is contacted with the caustic reagent and/or oxidizing agent can vary. For example, in certain embodiments, the time for which the bleached tobacco pulp is contacted with the caustic reagent and/or oxidizing agent is that amount of time sufficient to provide a whitened tobacco pulp with a lightened color as compared to the bleached tobacco pulp of the prior bleaching step. In certain embodiments, the bleached tobacco pulp is contacted with the caustic reagent and/or oxidizing agent overnight. Normally, the time period is a period of at least about 10 minutes, typically at least about 20 minutes, more often at least about 30 minutes. In certain embodiments, the time period is a period of no more than about 10 hours, no more than about 8 hours, no more than about 6 hours, no more than about 4 hours, no more than about 2 hours, or no more than about 1 hour.

In certain embodiments, before drying the bleached tobacco material, the bleached tobacco material can be treated with an acid to neutralize the tobacco material after the bleaching process to a pH in the range of about 5 to about 11 (as illustrated at operation 130 of FIG. 2, for example), such as about 6 to about 10. The bleached tobacco material can be treated with sulfuric acid, hydrochloric acid, citric acid, or any combination thereof. Other acids known in the art can also be used to neutralize the bleached tobacco material. Following treatment with an acid, the pH of the bleached tobacco material can be approximately 7.

Following bleaching of the extracted tobacco pulp, the bleached tobacco pulp is generally filtered (i.e., isolated from the steam mixture) and dried (as illustrated at operation 135 of FIG. 2, for example) to give a whitened tobacco material. In certain embodiments, the whitened tobacco material can be dried to a moisture level of about 1-30%, about 5-20%, or about 10-15% moisture on a wet basis.

After drying, the whitened tobacco material can optionally be milled a size in the range of approximately about 5 mm to about 0.1 mm, or about 1 mm to about 0.1 mm. In certain embodiments, the whitened tobacco material can be milled to a size of less than about 10 mm, less than about 5 mm, less than about 2 mm, or less than about 1 mm.

In various embodiments, a wood pulp is added to the tobacco input and/or the tobacco pulp during the overall whitening processes described herein. It is noted that wood pulp can be introduced into the whitening process at any of the steps described herein. For example, in certain embodiments, the methods described herein can further comprise mixing the tobacco input material with a wood material prior to pulping such that the wood material is also pulped. In certain embodiments, the methods described herein can further comprise mixing the tobacco pulp with a wood pulp after the pulping process and/or extraction process. In some embodiments, the wood pulp is a bleached pulp material and can be added after the solid tobacco materials have been pulped and bleached. If unbleached wood pulp is used, an additional caustic extraction step may be required, or the wood pulp can need to be added to the tobacco pulp before the step of bleaching.

In various embodiments, the wood pulp can be market available wood pulp. In certain embodiments, the wood pulp can be a bleached hardwood pulp. The wood pulp added to the processes described herein can be added in an amount of about 1 to about 20 wt. %, or about 5 to about 15 wt. %, based on the total weight of the pulp used (i.e., the total weight of tobacco pulp and wood pulp used). In some embodiments, the wood pulp can be added in an amount of at least about 1 wt. %, at least about 5 wt. %, or at least about 10 wt. %, based on the total weight of the pulp used. In certain embodiments, the wood pulp can be added in an amount of no more than about 5 wt. %, no more than about 10 wt. %, no more than about 15 wt. %, or no more than about 20 wt. %, based on the total weight of the pulp used.

In some embodiments, the bleached tobacco material thus produced can be characterized as lightened in color (e.g., "whitened") in comparison to the untreated tobacco material. Visual and/or instrumental assessments such as those previously described can be used to verify and, if desired, quantify the degree of lightening achieved by way of the presently described method of the invention. Assessment of the whiteness of a material generally requires comparison with another material. The extent of lightening can be quantified, for example, by spectroscopic comparison with an untreated tobacco sample (e.g., untreated tobacco pulp). White colors are often defined with reference to the International Commission on Illumination's (CIE's) chromaticity diagram. The bleached tobacco material can, in certain embodiments, be characterized as closer on the chromaticity diagram to pure white than unbleached tobacco material.

After drying, the whitened tobacco material can have an ISO brightness of at least about 50%, at least about 55%, at least about 60%, at least about 65%, at least about 70%, or at least about 75%. In some embodiments, the whitened tobacco material described herein can have an ISO brightness in the range of about 50% to about 90%, about 55% to about 75%, or about 60% to about 70%. ISO brightness can be measured according to ISO 3688:1999 or ISO 2470-1: 2016.

Whiteness of a material can also be characterized based on ASTM E313-73 Whiteness Test. The whiteness of a whitened tobacco material prepared according to the methods disclosed herein can be in the range of about 1-30, 5-25, 10-20, or 10-15, for example. In some embodiments, the whiteness of a whitened tobacco material prepared according to the methods disclosed herein can be at least about 5, at least about 10, at least about 12, at least about 15, at least about 20, or at least about 25.

Whitened tobacco materials as described herein may also be characterized based on TAPPI 2270M-99 Freeness Test. Freeness levels can be indicated as a CSF (Canadian Standard Freeness) value. Freeness level generally is an indicator of the drainage rate of pulp. The higher the value, the easier it is to drain the pulp in the papermaking process. Harsher bleaching processes typically used during bleaching of pulp materials can degrade the individual fibers and undesirably reduce the freeness in bleached tobacco pulps. Thus, the alternative whitening methods provided herein can beneficially produce whitened tobacco pulps and materials with higher freeness values as compared to typical bleaching processes. The freeness level of pure tobacco pulp can have a range of about 0 to about 500 CSF. In some embodiments, the freeness of the whitened tobacco materials produced herein can be in the range of about 300 CSF to about 800 CSF, or about 400 CSF to about 700 CSF, or about 500 CSF to about 600 CSF.

Whitened tobacco materials as described herein may also be characterized based on their cellulose to hemicellulose ratios. Typically, bleached tobacco pulps exhibit an increased cellulose to hemicellulose ratio with increased bleaching as typical bleaching processes remove hemicelluloses from the tobacco pulp. Thus, higher cellulose to hemicellulose ratios are desired as they demonstrate increased whitening (e.g., through hemicellulose and lignin removal) in the whitened tobacco materials produced according to the methods described herein. In some embodiments, the whitened tobacco materials produced herein can have a cellulose to hemicellulose ratio of at least 2:1, at least 5:1, at least 10:1, at least 15:1, at least 20:1, or at least 25:1. In some embodiments, the described whitened tobacco materials may have a cellulose to hemicellulose ratio in the range of about 2:1 to about 30:1, about 5:1 to about 20:1, or about 10:1 to about 15:1.

Alternative Whitening Method 2

In one aspect of the present disclosure a method of preparing a whitened tobacco material is provided, the method comprising: simultaneously extracting and bleaching a tobacco material with an extraction solution comprising an acid component to give a whitened tobacco pulp and a tobacco extract; and drying the whitened tobacco pulp to provide a whitened tobacco material. In such embodiments, the tobacco materials as described herein above undergo a single-step whitening process to produce a whitened tobacco material. Single-step whitening processes as described herein below provide for extraction and bleaching of a starting tobacco material in a single-step process carried out under acidic conditions. Advantageously, single-step whitening processes as described herein may improve efficiency and reduce the cost of whitening tobacco materials.

In some embodiments, the starting material may optionally be subjected to an additional extraction and/or filtering process to remove water soluble materials from the starting tobacco material prior to subjecting the tobacco material to the single-step whitening processes as described herein below. As illustrated at operation 140 of FIG. 3, for example, extraction of various water soluble components in the starting tobacco material is achieved during this single-step whitening process (e.g., as a single extraction and bleaching stage).

Various extraction techniques of tobacco materials can be used to provide a tobacco extract and tobacco pulp. The example extraction processes described with regard to Alternative Whitening Method 1 above are also applicable to Alternative Whitening Method 2. In certain embodiments, a solvent is added to the tobacco material and the material is soaked for a given period of time (e.g., about 1 h); the extraction product is then filtered to give a tobacco pulp and the solvent and any solubles contained therein are filtered off to give a tobacco extract.

The solvent used for the combined extraction and bleaching of the tobacco material can vary. It is noted that any of the solvents described with regard to Alternative Bleaching Method 1 above can also be used in the present method. In certain embodiments, the solvent comprises a solvent having an aqueous character, such as distilled/deionized water and/ or tap water. Typically, the treatment of the tobacco material comprises adding a large excess of one or more solvents to the tobacco material so as to produce a slurry (comprising, for example, 50-90% by weight of the solvent), although the amount of solvent can vary as discussed above.

According to embodiments of Alternative Whitening Method 2, a tobacco material is treated with an extraction solution comprising an acid component to provide a whitened tobacco pulp and a tobacco extract. In some embodiments, the extraction solution may be in the form of an aqueous solution including one or more components. In some embodiments, the aqueous extraction solution, including the at least one acid component and used for the combined extraction and bleaching of the tobacco material, may be referred to herein as the whitening solution. In some embodiments, the whitening solution may comprise one or more of the aforementioned solvents in addition to the acid component. In such embodiments, the tobacco material is whitened during this single-step whitening process due to contact with the whitening solution for a time suitable to provide a whitened tobacco pulp therefrom. In certain preferred embodiments, the acid component used according to the invention is peracetic acid or a combination of a mineral acid with and oxidizer (e.g., sulfuric acid, $H_2SO_4$, and peroxide, $H_2O_2$) to form a combined acid component. While peracetic acid is discussed in detail with respect to certain embodiments described herein below, various other peracids and/or combined acid components may be suitable for use in the disclosed methods and processes described herein and are intended to be encompassed by the present disclosure. It is well known that peracids are generally provided in two main classes, e.g., those derived from mineral acids or peroxy derivatives of organic carboxylic acids. Typically, peracids provide an oxidizing effect. Suitable peracids for use in the described methods may include, but are not limited to: a peracid derived from any mineral acid or organic carboxylic acid, or any combination of an acid and an oxidizer that can be mixed to form a peracid suitable for providing an oxidizing agent.

In preferred embodiments, the acid component may be peracetic acid. In such preferred embodiments, treatment of the tobacco material with the whitening solution comprising peracetic acid and one or more solvents can essentially provide extraction and bleaching characteristics in a single-step whitening process. The addition of peracetic acid or other peracids within the disclosed embodiment can be achieved using various addition methods known in the art. For example, methods for providing single-stage peracetic acid (PAA) pulping processes to cellulosic pulps are described in Zhao, Xuebing; van der Heide, Evert; Zhang, Ting; and Liu, Dehua; "*Single-Stage Pulping of Sugarcane Bagasse with Peracetic Acid*;" Journal of Wood Chemistry and Technology 2011; v. 31, No. 1, pp. 1-25; see, e.g., https://pubag.nal.usda.gov/catalog/295646; which is incorporated herein by reference in its entirety. It is noted, that when compared with typical kraft bleaching process, single-stage PAA pulping processes could obtain higher pulp yield and brightness, lower kappa number, and less degradation of carbohydrates.

In some embodiments, the peracetic acid in the whitening solution may be added to the tobacco material during the treatment in an amount in the range of about 50 kg per metric ton (MT) of bone dry (BD) fiber to about 500 kg/MT of BD fiber, or about 75 kg/MT of BD fiber to about 150 kg/MT of BD fiber, or about 90 kg/MT of BD fiber to about 120 kg/MT of BD fiber. In some embodiments, the peracetic acid may be added to the tobacco material during the treatment in an amount of at last about 50 kg/MT of BD fiber, at least about 100 kg/MT of BD fiber, at least about 200 kg/MT of BD fiber, at least about 300 kg/MT of BD fiber, or at least about 400 kg/MT of BD fiber.

Figure 3:
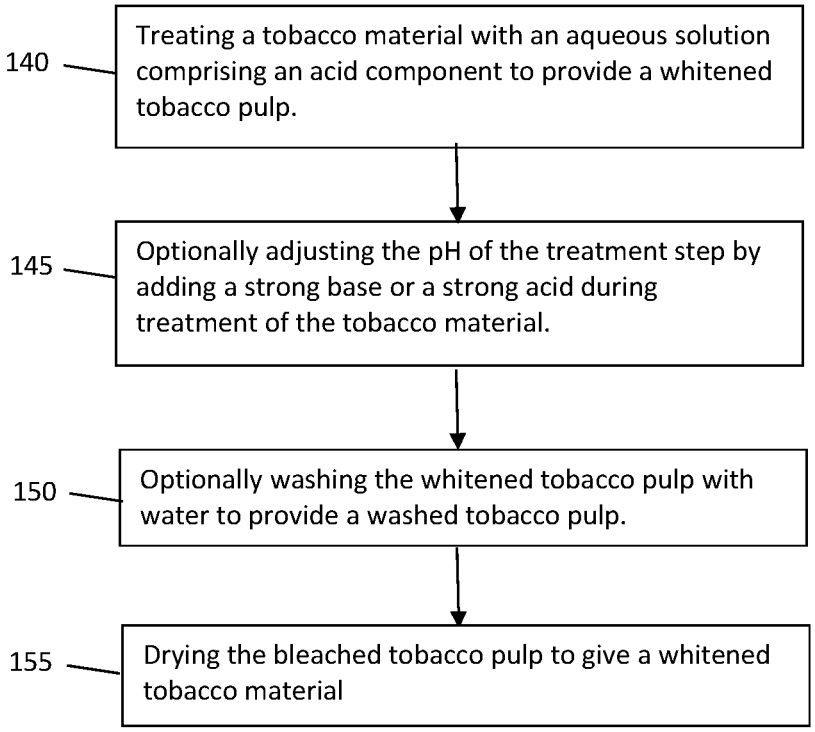
FIG. 3 is a flow chart illustrating the general steps for preparing a whitened tobacco material using a second method of whitening tobacco, according to an example embodiment of the present disclosure.

As illustrated in FIG. 3, for example, during the extraction and bleaching step (i.e., the treating step) at operation 140, the treatment of the tobacco material can be carried out at an acidic pH, a neutral pH, or a slightly alkaline pH. For example, in some embodiments the pH during the treatment step may be in the range of about 4 to about 8.5. In preferred embodiments, the treatment of the tobacco material during the bleaching step (i.e., the treating step) can be carried out at an acidic pH. For example, the pH during the treatment step may be about 7 or less, or about 6 or less, or about 5 or less, or about 4 or less, or about 3 or less, or about 2 or less, or about 1 or less. In some embodiments, the pH during the treatment step may be in the range of about 2 to about 7, or about 3 to about 6, or about 4.5 to about 5.5. Suitable pH ranges for bleaching with peracetic acid are described in Barros, Denise Pires; Silva, Vanessa Lopes; Hamalainen, Hannu; and Colodette, Jorge Luiz; "Effect of Last Stage Bleaching With Peracetic Acid On Brightness Development And Properties Of Eucalyptus Pulp;" BioResources, Vol. 5, No. 2 (2010); see, e.g., https://ojs.cnr.ncsu.edu/index.php/BioRes/article/view/BioRes_05_2_0881_Barros_SHC_Last_Stage_Bleaching_PeraceticAcid_Brightness; which is incorporated herein by reference in its entirety.

In some embodiments, the tobacco pulp slurry (e.g., mixture of the tobacco material, solvent, and acid component) may further undergo a pH adjustment step during the single-step whitening process to achieve the desired pH as shown at operation 145. Various compounds may be used to perform the desired pH adjustment during the process. For example, a strong base can be added to the tobacco pulp slurry in order to increase the pH of the slurry, or in most cases a strong acid can be added to the tobacco pulp slurry to reduce the pH into the desired acidic range. The tobacco pulp slurry, from which the aqueous solution is drained, can be optionally washed with water at operation 150.

In some embodiments, the tobacco material is heated during the treatment step. Generally, heating the tobacco material accelerates the whitening process. Where the tobacco material is heated during treatment, sufficient color lightening is typically achieved in less time than in embodiments wherein the tobacco material is unheated during treatment. The temperature and time of the heat treatment process will vary, and generally, the length of the heat treatment will decrease as the temperature of the heat treatment increases. In some embodiments, the temperature during treatment of the tobacco material can be between about 50° C. and about 150° C., about 70° C. to about 130° C. or about 90° C. to about 110° C. In certain embodiments, the temperature of the heat treatment can be at least about 60° C., at least about 80° C., at least about 100° C., or at least about 120° C. The heating can be carried out in an enclosed vessel (e.g., one providing for a controlled atmospheric environment, controlled atmospheric components, and a controlled atmospheric pressure), or in a vessel that is essentially open to ambient air. The temperature can be controlled by using a jacketed vessel, direct steam injection into the tobacco, bubbling hot air through the tobacco, and the like. In certain embodiments, the heating is performed in a vessel also capable of providing mixing of the composition, such as by stirring or agitation. Example mixing vessels include mixers available from Scott Equipment Company, Littleford Day, Inc., Lödige Process Technology, and the Breddo Likwifier Division of American Ingredients Company. Examples of vessels which provide a pressure controlled environment include high pressure autoclaves available from Berghof/America Inc. of Concord, California, and high pressure reactors available from The Parr Instrument Co. (e.g., Parr Reactor Model Nos. 4522 and 4552 described in U.S. Pat. No. 4,882,128 to Hukvari et al.).

In some embodiments, the tobacco material may optionally be superheated during the treatments step to reduce process time and/or to increase the whitening effect of the treatment. In such embodiments, to tobacco material may optionally be super-heated during the treatment step to temperatures in the range of about 500° C. to about 800° C., or about 550° C. to about 750° C., or about 600° C. to about 700° C. In some embodiments, the tobacco material may optionally be super-heated during the treatment step to temperatures of at least about 500° C., at least about 550° C., at least about 600° C., at least about 650° C., or at least about 700° C.

In some embodiments, the time of the treatment step may vary. For example, in certain embodiments, the time for which the tobacco material is treated is that amount of time sufficient to provide a whitened tobacco pulp material with a lightened color as compared to the untreated tobacco material. Normally, the time period is a period of at least about 10 minutes, typically at least about 20 minutes, more often at least about 30 minutes. In certain embodiments, the time period is a period of no more than about 10 hours, no more than about 8 hours, no more than about 6 hours, no more than about 4 hours, no more than about 2 hours, or no more than about 1 hour. Preferably, the treatment step is carried out for a time of about an hour and at a temperature of at least about 200° F.

In some embodiments, the treatment step may be carried out at various pressures and the pressure may be altered in the reaction vessel based on various other extraction parameters (e.g., such as temperature and time). In such embodiments, the process pressure, temperature, and time of the extraction will vary, and generally, the length of the heat treatment will decrease as the temperature and/or the pressure of the heat treatment increases. In some embodiments, the pressure within the mixing vessel during the extraction and bleaching treatment can vary, for example, the treatment step may be carried out at atmospheric pressure or elevated pressure (e.g., about 10 psig to about 1,000 psig). For embodiments conducted at elevated pressures, the time required for treatment may be reduced and/or the treatment may require lower temperatures as compared to treatment carried out under ambient pressure. In some embodiments, the pressure within the vessel during treatment of the tobacco material may be in the range of about 100 psig to about 200 psig, or about 110 psig to about 180 psig, or about 120 psig to about 170 psig, or about 130 psig to about 160 psig. In some embodiments, the pressure within the vessel during treatment of the tobacco material may be at least about 100 psig, at least about 120 psig, at least about 140 psig, or at least about 160 psig.

Following extraction and bleaching of the tobacco material, the whitened tobacco pulp is generally filtered (i.e., isolated from the steam mixture) and dried (as illustrated at operation 155 of FIG. 3, for example) to give a whitened tobacco material. In certain embodiments, the whitened tobacco material can be dried to a moisture level of about 1-30%, about 5-20%, or about 10-15% moisture on a wet basis.

After drying, the whitened tobacco material can optionally be milled a size in the range of approximately about 5 mm to about 0.1 mm, or about 1 mm to about 0.1 mm. In certain embodiments, the whitened tobacco material can be milled to a size of less than about 10 mm, less than about 5 mm, less than about 2 mm, or less than about 1 mm.

In some embodiments, the whitened tobacco material produced by extracting tobacco materials according to the methods presented above can be characterized as lightened in color (e.g., "whitened") in comparison to tobacco materials that have not undergone such an extraction step. Visual and/or instrumental assessments such as those previously described can be used to verify and, if desired, quantify the degree of lightening achieved by way of the presently described method of the invention. Assessment of the whiteness of a material generally requires comparison with another material. The extent of lightening can be quantified, for example, by spectroscopic comparison with an untreated tobacco sample (e.g., untreated tobacco pulp). White colors are often defined with reference to the International Commission on Illumination's (CIE's) chromaticity diagram. The whitened tobacco material can, in certain embodiments, be characterized as closer on the chromaticity diagram to pure white than tobacco pulps that have not undergone such an extraction step.

Whitened tobacco materials as described herein may also be characterized based on TAPPI 227OM-99 Freeness Test. Freeness levels can be indicated as a CSF (Canadian Standard Freeness) value. Freeness level generally is an indicator of the drainage rate of pulp. The higher the value, the easier it is to drain the pulp in the papermaking process. Harsher bleaching processes typically used during bleaching of pulp materials can degrade the individual fibers and undesirably reduce the freeness in bleached tobacco pulps. Thus, the alternative whitening methods provided herein can beneficially produce whitened tobacco pulps and materials with higher freeness values as compared to typical bleaching processes. The freeness level of pure tobacco pulp can have a range of about 0 to about 500 CSF. In some embodiments, the freeness of the whitened tobacco materials produced herein can be in the range of about 300 CSF to about 800 CSF, or about 400 CSF to about 700 CSF, or about 500 CSF to about 600 CSF.

Whitened tobacco materials as described herein may also be characterized based on their cellulose to hemicellulose ratios. Typically, bleached tobacco pulps exhibit an increased cellulose to hemicellulose ratio with increased bleaching as typical bleaching processes remove hemicelluloses from the tobacco pulp. Thus, higher cellulose to hemicellulose ratios are desired as they demonstrate increased whitening (e.g., through hemicellulose and lignin removal) in the whitened tobacco materials produced according to the methods described herein. In some embodiments, the whitened tobacco materials produced herein can have a cellulose to hemicellulose ratio of at least 2:1, at least 5:1, at least 10:1, at least 15:1, at least 20:1, or at least 25:1, based on the total dry weight of the whitened tobacco material. In some embodiments, the described whitened tobacco materials may have a cellulose to hemicellulose ratio in the range of about 2:1 to about 30:1, about 5:1 to about 20:1, or about 10:1 to about 15:1, based on the dry weight of the whitened tobacco material.

Alternative Bleaching Method 3

In one aspect of the present disclosure, a method of preparing a whitened tobacco material is provided, the method comprising: subjecting a tobacco material to hot water extraction for a time and at a temperature and a pressure sufficient to lighten the color of the tobacco material to give a whitened tobacco solids material and a tobacco extract, and drying the whitened tobacco solids material to provide the whitened tobacco material.

Figure 4:
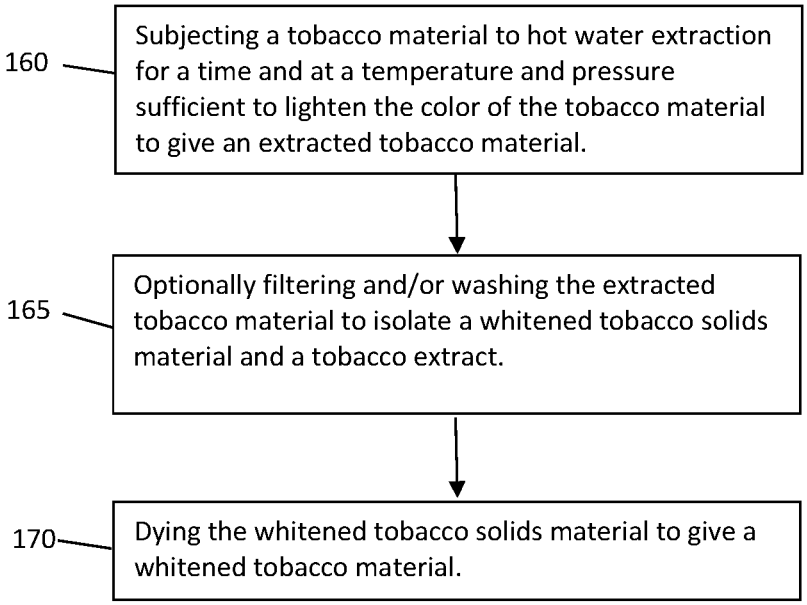
FIG. 4 is a flow chart illustrating the general steps for preparing a whitened tobacco material using a third method of whitening tobacco, according to an example embodiment of the present disclosure.

As illustrated at operation 160 of FIG. 4, for example, a tobacco material can be subjected to hot water extraction (HWE). Hot water extraction (HWE) as described herein refers to any type of hot water or steam treatment that involves contacting a tobacco material with hot water and/or steam for a period of time at high temperature and high pressure suitable to remove various aqueous components from the tobacco material to give a whitened tobacco solids material and a tobacco extract. In some embodiments, the hot water extraction may be carried out in various different forms and methods. In some embodiments for example, the tobacco material is subjected to hot water extraction in a flow-through reactor to provide a whitened tobacco solids material therefrom. Various methods for subjecting cellulosic pulps to hot water extraction are described in Borrega, Marc, and Herbert Sixta; "*Purification of Cellulosic Pulp by Hot Water Extraction*;" Cellulose 20.6 (2013): 2803-2812; see, e.g., https://dspace.mit.edu/handle/1721.1/105779; which is incorporated herein by reference in its entirety. In some embodiments, the starting tobacco material may optionally be subjected to an extraction and/or filtering process to remove water soluble materials from the starting tobacco material prior to subjecting the tobacco material to hot water extraction as described herein below.

In some embodiments, tobacco materials as described herein above may be extracted with high temperature and high pressure liquid compositions (e.g., such as hot water or steam) to provide a whitened tobacco solids material therefrom. Advantageously, it was discovered by the inventors that use of hot water extraction in a single-stage extraction step may provide increased tobacco pulp yield while also producing a whitened tobacco solids material. For example, pulp yields of at least 35 percent, or at least 40 percent, or at least 45 percent, or at least 50 percent, or at least 55 percent or at least 60 percent may be achieved. Further, it should be noted that the process according the Alternative Whitening Method 3 as described herein may provide low retention times desirably producing removal of lignin and hemicelluloses (e.g., colored matter) while minimizing fiber degradation in the extracted tobacco pulp. In some embodiments, hot water extraction methods according to the present disclosure may reduce the amount of bleaching chemicals needed to achieve the desired level of whiteness in the whitened tobacco solids material, especially as compared to other bleaching processes. In some embodiments, the whitening methods described herein may be essentially chlorine-free. In such embodiments, these alternative bleaching methods advantageously produce effluents with less chemical byproducts which is beneficial to the environment.

In some embodiments, the hot water extraction may optionally include one or more bleaching agents to enhance the whitening of the tobacco solids material. In some embodiments, the hot water extraction may include a caustic reagent, such as caustic soda (i.e., sodium hydroxide, NaOH), and/or various other bleaching agents as described herein above regarding Alternative Whitening Method 1. In such embodiments, it should be noted that the amount of bleaching agent required to achieve the desired whiteness is typically lower for the disclosed methods as compared to typical caustic soda bleaching and/or extraction processes that do not use a combination of hot water extraction and a bleaching agent. Therefore, such embodiments, likewise, produce effluents with less chemical byproducts as compared to typical caustic bleaching or extraction techniques not carried out at such high temperatures and pressures.

The temperature, pressure, and time of the hot water extraction process will vary, and generally at higher temperatures and higher pressures the amount of time is necessarily lower. In some embodiments, temperatures during hot water extraction of the tobacco material may be in the range of about 200° C. to about 280° C., or about 210° C. to about 270° C., or about 220° C. to about 260° C., or about 230° C. to about 250° C., or preferably about 240° C.

The heating can be carried out in an enclosed vessel (e.g., one providing for a controlled atmospheric environment, controlled atmospheric components, and a controlled atmospheric pressure), or in a vessel that is essentially open to ambient air. The temperature can be controlled by using a jacketed vessel, direct steam injection into the tobacco, bubbling hot air through the tobacco, and the like. In certain embodiments, the heating is performed in a vessel also capable of providing mixing of the composition, such as by stirring or agitation. Example mixing vessels include mixers available from Scott Equipment Company, Littleford Day, Inc., Lödige Process Technology, and the Breddo Likwifier Division of American Ingredients Company.

In some embodiments, the vessel may also be pressurized to apply the desired pressure to the reaction vessel. In some embodiments, the pressure within the vessel may be in the range of about 20 bar to about 60 bar, or about 30 bar to about 50 bar, or about 40 bar. Various types of pressurized vessels typically used in traditional pulping processes may be suitable for use in the described method. Examples of vessels which provide a pressure controlled environment include high pressure autoclaves available from Berghof/America Inc. of Concord, California, and high pressure reactors available from The Parr Instrument Co. (e.g., Parr Reactor Model Nos. 4522 and 4552 described in U.S. Pat. No. 4,882,128 to Hukvari et al.).

The time required for hot water extraction may vary and typically can be reduced with higher process temperatures and pressures. Generally, the time required for hot water extraction is not intended to exceed 24 hours. For example, in some embodiments, the time period required for hot water extraction may be a period of time in the range of about 1 hour to about 24 hours, about 4 hours to about 18 hours, or about 8 hours to about 12 hours. In some embodiments the time required for hot water extraction may be a period of less than about 24 hours, less than about 18 hours, less than about 12 hours, less than about 8 hours, less than about 4 hours, or less than about 2 hours.

As noted above, in some embodiments, the hot water extraction may be carried out, alternatively, in a flow-through reactor to provide flow-through hot water extraction. In such embodiments, the flow-through hot water extraction process can be provided at various temperatures and pressures. For example, the temperature, pressure, and time of the hot water extraction process will vary, and generally at higher temperatures and higher pressures the amount of time is necessarily lower. In some embodiments, temperatures during flow-through hot water extraction of the tobacco material may be in the range of about 200° C. to about 280° C., or about 210° C. to about 270° C., or about 220° C. to about 260° C., or about 230° C. to about 250° C., or preferably about 240° C.

In some embodiments, the flow-through reactor may also be pressurized to apply the desired pressure to the reactor. For example, pressures may vary within the flow through reactor. In some embodiments, the pressure within the vessel may be in the range of about 20 bar to about 60 bar, or about 30 bar to about 50 bar, or about 40 bar. Various types of pressurized vessels typically used in traditional pulping processes may be suitable for use in the described method. Various method for flow-through hot water extraction are described in Borrega, Marc, and Herbert Sixta; "*Purification of Cellulosic Pulp by Hot Water Extraction*;" Cellulose 20.6 (2013): 2803-2812; see, e.g., https://dspace.mit.edu/handle/1721.1/105779; which is incorporated herein by reference in its entirety Following hot water extraction of the tobacco material (illustrated at operation 160 of FIG. 4, for example), the extracted tobacco material may optionally be filtered or washed to isolate the whitened tobacco solids material and the tobacco extract (as illustrated at operation 165 of FIG. 4, for example). Following the HWE of the tobacco material and the optional wash/filtration of the whitened tobacco solids material, the whitened tobacco solids material can be dried (as illustrated at operation 170 of FIG. 4, for example) to give a whitened tobacco material. In certain embodiments, the whitened tobacco material can be dried to a moisture level of about 1-30%, about 5-20%, or about 10-15% moisture on a wet basis.

After drying, the whitened tobacco material can optionally be milled a size in the range of approximately about 5 mm to about 0.1 mm, or about 1 mm to about 0.1 mm. In certain embodiments, the whitened tobacco material can be milled to a size of less than about 10 mm, less than about 5 mm, less than about 2 mm, or less than about 1 mm.

In some embodiments, the whitened tobacco material produced by extracting tobacco materials according to the methods presented above can be characterized as lightened in color (e.g., "whitened") in comparison to tobacco materials that have not undergone such an extraction step. Visual and/or instrumental assessments such as those previously described can be used to verify and, if desired, quantify the degree of lightening achieved by way of the presently described method of the invention. Assessment of the whiteness of a material generally requires comparison with another material. The extent of lightening can be quantified, for example, by spectroscopic comparison with an untreated tobacco sample (e.g., untreated tobacco pulp). White colors are often defined with reference to the International Commission on Illumination's (CIE's) chromaticity diagram. The whitened tobacco material can, in certain embodiments, be characterized as closer on the chromaticity diagram to pure white than tobacco materials that have not undergone such an extraction step.

Incorporating Whitened Tobacco Materials into Tobacco Products

The whitened tobacco materials discussed in any of the above methods (e.g., alternative whitening methods 1, 2, and 3) of the present disclosure can optionally be treated and/or processed in other ways before, after, or during the process steps described above. For example, if desired, the tobacco materials can be irradiated, pasteurized, or otherwise subjected to controlled heat treatment. Such treatment processes are detailed, for example, in US Pat. Pub. No. 2009/0025738 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof), and combinations thereof. See, for example, the types of treatment processes described in US Pat. Pub. Nos. 2010/0300463 and 2011/0048434 to Chen et al., and U.S. Pat. No. 8,991,403 to Chen et al., which are all incorporated herein by reference. In certain embodiments, this type of treatment is useful where the original tobacco material is subjected to heat in the extraction and/or distillation process previously described.

The whitened tobacco material can be incorporated within a smokeless tobacco product according to the present invention. Depending on the type of tobacco product being processed, the tobacco product can include one or more additional components in addition to the whitened tobacco material as described above. For example, the whitened tobacco material can be processed, blended, formulated, combined and/or mixed with other materials or ingredients, such as other tobacco materials or flavorants, fillers, binders, pH adjusters, buffering agents, salts, sweeteners, colorants, oral care additives, disintegration aids, antioxidants, humectants, and preservatives. See, for example, those representative components, combination of components, relative amounts of those components and ingredients relative to tobacco, and manners and methods for employing those components, set forth in US Pat. Pub. Nos. 2011/0315154 to Mua et al.; 2007/0062549 to Holton, Jr. et al.; 2012/0067361 to Bjorkholm et al.; 2017/0020183 to Bjorkholm; and 2017/0112183 to Bjorkholm; and U.S. Pat. No. 7,861,728 to Holton, Jr. et al., each of which is incorporated herein by reference.

The relative amount of whitened tobacco material within the smokeless tobacco product may vary. Preferably, the amount of whitened tobacco material within the smokeless tobacco product is at least about 10%, at least about 25%, at least about 50%, at least about 60%, at least about 70%, at least about 80%, or at least about 90% on a dry weight basis of the formulation. A typical range of tobacco material within the formulation is about 1 to about 99%, more often about 10 to about 50% by weight on a dry basis.

The whitened tobacco material used for the manufacture of the smokeless tobacco products of the invention preferably is provided in a ground, granulated, fine particulate, or powdered form. Although not strictly necessary, the whitened tobacco material may be subjected to processing steps that provide a further grinding for further particle size reduction. The whitening processes of the present invention generally provide a whitened tobacco material with a decreased amount of high molecular weight compounds, leading to more interstitial room and thus higher possible water content in smokeless tobacco materials produced therefrom than those from unwhitened tobacco materials. In certain embodiments, the smokeless tobacco products produced according to the invention provide for faster nicotine release than products produced from unwhitened tobacco materials.

Example flavorants that can be used are components, or suitable combinations of those components, that act to alter the bitterness, sweetness, sourness, or saltiness of the smokeless tobacco product, enhance the perceived dryness or moistness of the formulation, or the degree of tobacco taste exhibited by the formulation. Flavorants may be natural or synthetic, and the character of the flavors imparted thereby may be described, without limitation, as fresh, sweet, herbal, confectionary, floral, fruity, or spicy. Specific types of flavors include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., Tobacco Flavoring for Smoking Products, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite (e.g., spearmint and menthol, or orange and cinnamon). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. Types of flavorants include salts (e.g., sodium chloride, potassium chloride, sodium citrate, potassium citrate, sodium acetate, potassium acetate, and the like), natural sweeteners (e.g., fructose, sucrose, glucose, maltose, mannose, galactose, lactose, and the like), artificial sweeteners (e.g., sucralose, saccharin, aspartame, acesulfame K, neotame, and the like); and mixtures thereof. The amount of flavorants utilized in the tobacco composition can vary, but is typically up to about 10 dry weight percent, and certain embodiments are characterized by a flavorant content of at least about 1 dry weight percent, such as about 1 to about 10 dry weight percent. Combinations of flavorants are often used, such as about 0.1 to about 2 dry weight percent of an artificial sweetener, about 0.5 to about 8 dry weight percent of a salt such as sodium chloride and about 1 to about 5 dry weight percent of an additional flavoring.

Example filler materials include vegetable fiber materials such as sugar beet fiber materials (e.g., FIBREX® brand filler available from International Fiber Corporation), oats or other cereal grain (including processed or puffed grains), bran fibers, starch, or other modified or natural cellulosic materials such as microcrystalline cellulose. Additional specific examples include corn starch, maltodextrin, dextrose, calcium carbonate, calcium phosphate, lactose, manitol, xylitol, and sorbitol. The amount of filler, where utilized in the tobacco composition, can vary, but is typically up to about 60 dry weight percent, and certain embodiments are characterized by a filler content of up to about 50 dry weight percent, up to about 40 dry weight percent or up to about 30 dry weight percent. Combinations of fillers can also be used.

Typical binders can be organic or inorganic, or a combination thereof. Representative binders include povidone, sodium carboxymethylcellulose and other modified cellulosic materials, sodium alginate, xanthan gum, starch-based binders, gum arabic, pectin, carrageenan, pullulan, zein, and the like. The amount of binder utilized in the tobacco composition can vary, but is typically up to about 30 dry weight percent, and certain embodiments are characterized by a binder content of at least about 5 dry weight percent, such as about 5 to about 30 dry weight percent.

Preferred pH adjusters or buffering agents provide and/or buffer within a pH range of about 6 to about 10, and example agents include metal hydroxides, metal carbonates, metal bicarbonates, and mixtures thereof. Specific example materials include citric acid, sodium hydroxide, potassium hydroxide, potassium carbonate, sodium carbonate, and sodium bicarbonate. The amount of pH adjuster or buffering material utilized in the tobacco composition can vary, but is typically up to about 5 dry weight percent, and certain embodiments can be characterized by a pH adjuster/buffer content of less than about 0.5 dry weight percent, such as about 0.05 to about 0.2 dry weight percent. Particularly in embodiments comprising an extract clarified by distillation, the pH may be lowered by the addition of one or more pH adjusters (e.g., citric acid).

A colorant may be employed in amounts sufficient to provide the desired physical attributes to the tobacco formulation. Example colorants include various dyes and pigments, such as caramel coloring and titanium dioxide. The amount of colorant utilized in the tobacco composition can vary, but is typically up to about 3 dry weight percent, and certain embodiments are characterized by a colorant content of at least about 0.1 dry weight percent, such as about 0.5 to about 3 dry weight percent.

Example humectants include glycerin and propylene glycol. The amount of humectant utilized in the tobacco composition can vary, but is typically up to about 5 dry weight percent, and certain embodiments can be characterized by a humectant content of at least about 1 dry weight percent, such as about 2 to about 5 dry weight percent.

Other ingredients such as preservatives (e.g., potassium sorbate), disintegration aids (e.g., microcrystalline cellulose, croscarmellose sodium, crospovidone, sodium starch glycolate, pregelatinized corn starch, and the like), and/or antioxidants can also be used. Typically, such ingredients, where used, are used in amounts of up to about 10 dry weight percent and usually at least about 0.1 dry weight percent, such as about 0.5 to about 10 dry weight percent. A disintegration aid is generally employed in an amount sufficient to provide control of desired physical attributes of the tobacco formulation such as, for example, by providing loss of physical integrity and dispersion of the various component materials upon contact of the formulation with water (e.g., by undergoing swelling upon contact with water).

As noted, in some embodiments, any of the components described above can be added in an encapsulated form (e.g., in the form of microcapsules), the encapsulated form a wall or barrier structure defining an inner region and isolating the inner region permanently or temporarily from the tobacco composition. The inner region includes a payload of an additive either adapted for enhancing one or more sensory characteristics of the smokeless tobacco product, such as taste, mouthfeel, moistness, coolness/heat, and/or fragrance, or adapted for adding an additional functional quality to the smokeless tobacco product, such as addition of an antioxidant or immune system enhancing function. See, for example, the subject matter of US Pat. Appl. Pub. No. 2009/0025738 to Mua et al., which is incorporated herein by reference.

Representative tobacco formulations may incorporate about 5% to about 95% percent whitened tobacco material, about 5 to about 60% filler, about 0.1% to about 5% artificial sweetener, about 0.5% to about 2% salt, about 1% to about 5% flavoring, about 1% to about 5% humectants (e.g., propylene glycol), and up to about 10% pH adjuster or buffering agent (e.g., sodium bicarbonate or citric acid), based on the total dry weight of the tobacco formulation. The particular percentages and choice of ingredients will vary depending upon the desired flavor, texture, and other characteristics.

Descriptions of various components of snus types of products and components thereof also are set forth in US Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and US Pat. Pub. No. 2005/0061339 to Hansson et al.; each of which is incorporated herein by reference.

The components of the tobacco composition can be brought together in admixture using any mixing technique or equipment known in the art. The optional components noted above, which may be in liquid or dry solid form, can be admixed with the whitened tobacco material in a pretreatment step prior to mixture with any remaining components of the composition or simply mixed with the whitened tobacco material together with all other liquid or dry ingredients. Any mixing method that brings the tobacco composition ingredients into intimate contact can be used. A mixing apparatus featuring an impeller or other structure capable of agitation is typically used. Example mixing equipment includes casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, and the like. As such, the overall mixture of various components with the whitened tobacco material may be relatively uniform in nature. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. Manners and methods for formulating snus-type tobacco formulations will be apparent to those skilled in the art of snus tobacco product production.

The moisture content of the smokeless tobacco product prior to use by a consumer of the formulation may vary. Typically, the moisture content of the product, as present within the pouch prior to insertion into the mouth of the user, is less than about 55 weight percent, generally is less than about 50 weight percent, and often is less than about 45 weight percent. For certain tobacco products, such as those incorporating snus-types of tobacco compositions, the moisture content may exceed 20 weight percent, and often may exceed 30 weight percent. For example, a representative snus-type product may possess a tobacco composition exhibiting a moisture content of about 20 weight percent to about 50 weight percent, preferably about 20 weight percent to about 40 weight percent.

The manner by which the moisture content of the formulation is controlled may vary. For example, the formulation may be subjected to thermal or convection heating. As a specific example, the formulation may be oven-dried, in warmed air at temperatures of about 40° C. to about 95° C., with a preferred temperature range of about 60° C. to about 80° C. for a length of time appropriate to attain the desired moisture content. Alternatively, tobacco formulations may be moistened using casing drums, conditioning cylinders or drums, liquid spray apparatus, ribbon blenders, or mixers. Most preferably, moist tobacco formulations, such as the types of tobacco formulations employed within snus types of products, are subjected to pasteurization or fermentation. Techniques for pasteurizing/heat treating and/or fermenting snus types of tobacco products will be apparent to those skilled in the art of snus product design and manufacture.

The acidity or alkalinity of the tobacco formulation, which is often characterized in terms of pH, can vary. Typically, the pH of that formulation is at least about 6.5, and preferably at least about 7.5. In some embodiments, the pH of that formulation will not exceed about 11, or will not exceed about 9, and often will not exceed about 8.5. A representative tobacco formulation exhibits a pH of about 6.8 to about 8.2 (e.g., about 7.8). A representative technique for determining the pH of a tobacco formulation involves dispersing 5 g of that formulation in 100 ml of high performance liquid chromatography water, and measuring the pH of the resulting suspension/solution (e.g., with a pH meter).

In certain embodiments, the whitened tobacco material and any other components noted above are combined within a moisture-permeable packet or pouch that acts as a container for use of the tobacco. The composition/construction of such packets or pouches, such as the container pouch 20 in the embodiment illustrated in FIG. 1, may be varied. Suitable packets, pouches or containers of the type used for the manufacture of smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf, Epok, and TreAnkrare. The tobacco formulation may be contained in pouches and packaged, in a manner and using the types of components used for the manufacture of conventional snus types of products. The pouch provides a liquid-permeable container of a type that may be considered to be similar in character to the mesh-like type of material that is used for the construction of a tea bag. Components of the loosely arranged, granular tobacco formulation readily diffuse through the pouch and into the mouth of the user.

Non-limiting examples of suitable types of pouches are set forth, for example, U.S. Pat. No. 5,167,244 to Kjerstad and U.S. Pat. No. 8,931,493 to Sebastian et al.; as well as US Patent App. Pub. Nos. 2016/0000140 to Sebastian et al.; 2016/0073689 to Sebastian et al.; 2016/0157515 to Chapman et al.; and 2016/0192703 to Sebastian et al., each of which are incorporated herein by reference. Pouches can be provided as individual pouches, or a plurality of pouches (e.g., 2, 4, 5, 10, 12, 15, 20, 25 or 30 pouches) can be connected or linked together (e.g., in an end-to-end manner) such that a single pouch or individual portion can be readily removed for use from a one-piece strand or matrix of pouches.

A pouch may, for example, be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other example pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material. In various embodiments, a nonwoven web can be used to form an outer water-permeable pouch which can be used to house a composition adapted for oral use.

The amount of material contained within each product unit, for example, a pouch, may vary. In some embodiments, the weight of the material within each pouch is at least about 50 mg, for example, from about 50 mg to about 1 gram, from about 100 to 800 about mg, or from about 200 to about 700 mg. In some smaller embodiments, the weight of the material within each pouch may be from about 100 to about 300. For a larger embodiment, the weight of the material within each pouch may be from about 300 mg to about 700 mg. If desired, other components can be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

The smokeless tobacco product can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; D592,956 to Thiellier; D594,154 to Patel et al.; and D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; 2010/0264157 to Bailey et al.; 2011/0168712 to Bailey et al.; and 2011/0204074 to Gelardi et al., which are incorporated herein by reference.

Products of the present disclosure may be packaged and stored in much the same manner that conventional types of smokeless tobacco products are packaged and stored. For example, a plurality of packets or pouches may be contained in a container used to contain smokeless tobacco products, such as a cylindrical container sometimes referred to as a "puck". The container can be any shape, and is not limited to cylindrical containers. Such containers may be manufactured out of any suitable material, such as metal, molded plastic, fiberboard, combinations thereof, etc. If desired, moist tobacco products (e.g., products having moisture contents of more than about 20 weight percent) may be refrigerated (e.g., at a temperature of less than about 10° C., often less than about 8° C., and sometimes less than about 5° C.). Alternatively, relatively dry tobacco products (e.g., products having moisture contents of less than about 15 weight percent) often may be stored under a relatively wide range of temperatures.

Various smokeless tobacco products disclosed herein are advantageous in that they provide a composition that is non-staining, or is staining to a lesser degree than products comprising only unwhitened tobacco materials. These products thus are desirable in reducing staining of teeth and clothing that may come in contact therewith. It is noted that even the spent (used) product is lighter in color than traditional spent (used) oral tobacco products. Further, the products may have enhanced visual appeal by virtue of their whitened color.

Many modifications and other embodiments will come to mind to one skilled in the art to which this disclosure pertains having the benefit of the teachings presented in the foregoing description. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method of preparing a whitened tobacco material, the method comprising:

a. treating a tobacco material with an extraction solution comprising an acid component to provide a tobacco pulp and a tobacco extract, wherein the tobacco material is treated for a time and at a temperature sufficient to lighten the color of the tobacco pulp to give a whitened tobacco pulp; and b. drying the whitened tobacco pulp to provide the whitened tobacco material.

2. The method of claim 1, wherein the extraction solution is an aqueous solution.

3. The method of claim 1, wherein the acid component is peracetic acid.

4. The method of claim 1, wherein the acid component comprises a mineral acid and an oxidizer.

5. The method of claim 1, wherein the tobacco material is treated at a pressure greater than ambient pressure.

6. The method of claim 1, wherein the tobacco material is treated at a pH of about 7 or less.

7. The method of claim 1, wherein the tobacco material is treated at a temperature of at least about 200° C.

8. The method of claim 1, wherein the whitened tobacco pulp is dried to a moisture content of less than about 30 percent moisture on a wet basis.

9. The method of claim 1, further comprising milling the whitened tobacco material following drying the whitened tobacco pulp to a size in the range of approximately 5 mm to about 0.1 mm.

10. The method of claim 1, further comprising incorporating the whitened tobacco material within a smokeless tobacco product.

11. The method of claim 10, wherein the smokeless tobacco product further comprises one or more additional components selected from the group consisting of flavorants, fillers, binders, pH adjusters, buffering agents, colorants, disintegration aids, antioxidants, humectants, and preservatives.

* * * * *